US010527332B2

(12) United States Patent
Connell et al.

(10) Patent No.: US 10,527,332 B2
(45) **Date of Patent: *Jan. 7, 2020**

(54) REFRIGERATION SYSTEM WITH SUPERHEATING, SUB-COOLING AND REFRIGERANT CHARGE LEVEL CONTROL

(71) Applicant: Bergstrom, Inc., Rockford, IL (US)

(72) Inventors: Brett S. Connell, Winnebago, IL (US); Aaron D. Sullivan, Winnebago, IL (US); Brett J. Herrmann, Rochelle, IL (US); Terry Zeigler, Byron, IL (US)

(73) Assignee: Bergstrom, Inc., Rockford, IL (US)

( * ) Notice: Subject to any disclaimer, the term of this patent is extended or adjusted under 35 U.S.C. 154(b) by 23 days.

This patent is subject to a terminal disclaimer.

(21) Appl. No.: 15/816,993

(22) Filed: Nov. 17, 2017

(65) Prior Publication Data

US 2018/0073789 A1 Mar. 15, 2018

Related U.S. Application Data

(63) Continuation of application No. 14/995,119, filed on Jan. 13, 2016, now Pat. No. 9,874,384.

(51) Int. Cl.
*F25B 45/00* (2006.01)
*F25B 40/02* (2006.01)
(Continued)

(52) U.S. Cl.
CPC ..... *F25B 45/00* (2013.01); *F25B 13/00* (2013.01); *F25B 40/02* (2013.01); *F25B 40/06* (2013.01);
(Continued)

(58) Field of Classification Search
CPC ..... F25B 45/00; F25B 13/00; F25B 30/02; F25B 43/006; F25B 43/003; F25B 40/06;
(Continued)

(56) References Cited

U.S. PATENT DOCUMENTS 2,722,050 A 11/1955 Shank
2,789,234 A 6/1956 Lambert et al.
(Continued)

FOREIGN PATENT DOCUMENTS

CN 1468409 A 1/2004
CN 2883071 Y 3/2007
(Continued)

OTHER PUBLICATIONS

Alfa Laval Website http://www.alfalaval.com/ecore-Java/WebObjects/ecoreJava.woa/wa/shoNode?siteNodelID-1668&cont . . . ; date last visited May 18, 2007; 1 page.
(Continued)

*Primary Examiner* — Emmanuel E Duke
(74) *Attorney, Agent, or Firm* — Morgan, Lewis & Bockius LLP

(57) ABSTRACT

The various embodiments described herein include methods, devices, and systems for determining refrigerant charge level. In one aspect, a refrigeration system includes: (1) a compressor to compress a refrigerant; (2) a condenser disposed downstream of the compressor to condense the refrigerant; (3) an evaporator disposed downstream of the condenser to vaporize the refrigerant; (4) refrigerant lines fluidly connecting the compressor, the condenser and the evaporator in series to form a refrigerant circuit for circulating the refrigerant; (5) at least one sensor configured to measure temperature and pressure of the refrigerant in the refrigerant circuit; and (6) a controller communicatively coupled to the at least one sensor and configured to: (a) determine a sub-cooling level or super-heating level based on the temperature and/or pressure measured by the at least one sensor; and (b) facilitate operation of the refrigeration system based on the sub-cooling level or the super-heating level.

27 Claims, 10 Drawing Sheets

(51) Int. Cl.

| | |
|---|---|
| ***F25B 40/06*** | (2006.01) |
| ***F25B 43/00*** | (2006.01) |
| ***F25B 13/00*** | (2006.01) |
| ***F25B 49/02*** | (2006.01) |

(52) U.S. Cl.
CPC ..... *F25B 43/003* (2013.01); *F25B 43/006* (2013.01); *F25B 49/02* (2013.01); *F25B 2339/0441* (2013.01); *F25B 2345/00* (2013.01); *F25B 2345/001* (2013.01); *F25B 2345/003* (2013.01); *F25B 2345/006* (2013.01); *F25B 2400/16* (2013.01); *F25B 2500/24* (2013.01); *F25B 2600/05* (2013.01); *F25B 2700/04* (2013.01); *F25B 2700/195* (2013.01); *F25B 2700/1933* (2013.01); *F25B 2700/2108* (2013.01); *F25B 2700/2111* (2013.01); *F25B 2700/2113* (2013.01)

(58) Field of Classification Search
CPC ..... F25B 40/02; F25B 49/027; F25B 49/025; F25B 49/005; F25B 49/02; F25B 2339/0441; F25B 2500/24; F25B 2400/16; F25B 2345/00; F25B 2700/211; F25B 2700/2108; F25B 2700/195; F25B 2700/1933; F25B 2345/006; F25B 2345/003; F25B 2345/001; F25B 2700/04; F25B 2600/05; F25B 2700/2113
See application file for complete search history.

(56) References Cited

U.S. PATENT DOCUMENTS 3,176,502 A 4/1965 Cizek et al.
3,225,819 A 12/1965 Stevens
3,590,910 A 7/1971 Lorenz
3,627,030 A 12/1971 Lorenz
3,807,087 A 4/1974 Staats
3,844,130 A 10/1974 Wahnish
3,880,224 A 4/1975 Weil
3,885,398 A 5/1975 Dawkins
3,948,060 A 4/1976 Gaspard
3,995,443 A 12/1976 Iversen
4,015,182 A 3/1977 Erdman
4,034,801 A 7/1977 Bermstein
4,071,080 A 1/1978 Bridgers
4,217,764 A 8/1980 Armbruster
4,271,677 A 6/1981 Harr
4,280,330 A 7/1981 Harris et al.
4,324,286 A 4/1982 Brett
4,359,875 A 11/1982 Ohtani
4,391,321 A 7/1983 Thunberg
4,412,425 A 11/1983 Fukami et al.
4,448,157 A 5/1984 Eckstein et al.
4,459,519 A 7/1984 Erdman
4,577,679 A 3/1986 Hibshman
4,604,036 A 8/1986 Sutou et al.
4,617,472 A 10/1986 Slavik
4,641,502 A 2/1987 Aldrich et al.
4,658,593 A 4/1987 Stenvinkel
4,667,480 A 5/1987 Bessler
4,694,798 A 9/1987 Kato et al.
4,748,825 A 6/1988 King
4,825,663 A 5/1989 Nijar et al.
4,841,733 A 6/1989 Dussault et al.
4,856,078 A 8/1989 Konopka
4,893,479 A 1/1990 Gillett et al.
4,905,478 A 3/1990 Matsuda et al.
4,945,977 A 8/1990 D'Agaro
4,947,657 A 8/1990 Kalmbach
4,952,283 A 8/1990 Besik
4,982,576 A 1/1991 Proctor et al.
5,025,634 A 6/1991 Dressler
5,046,327 A 9/1991 Walker
5,067,652 A 11/1991 Enander
5,095,308 A 3/1992 Hewitt
5,125,236 A 6/1992 Clancey et al.
5,170,639 A 12/1992 Datta
5,205,781 A 4/1993 Kanno
5,230,719 A 7/1993 Berner et al.
5,275,012 A 1/1994 Dage et al.
5,307,645 A 5/1994 Pannell
5,316,074 A 5/1994 Isaji et al.
5,324,229 A 6/1994 Weisbecker
5,333,678 A 8/1994 Mellum et al.
5,361,593 A 11/1994 Dauvergne
5,376,866 A 12/1994 Erdman
5,396,779 A 3/1995 Voss
5,402,844 A 4/1995 Elluin
5,404,730 A 4/1995 Westermeyer
5,426,953 A 6/1995 Meckler
5,465,589 A 11/1995 Bender et al.
5,497,941 A 3/1996 Numazawa et al.
5,501,267 A 3/1996 Iritani et al.
5,502,365 A 3/1996 Nanbu et al.
5,524,442 A 6/1996 Bergmen, Jr. et al.
5,528,901 A 6/1996 Willis
5,562,538 A 10/1996 Suyama
5,586,613 A 12/1996 Ehsani
5,647,534 A 7/1997 Kelz et al.
5,657,638 A 8/1997 Erdman et al.
5,682,757 A 11/1997 Peterson
5,720,181 A 2/1998 Karl et al.
5,752,391 A * 5/1998 Ozaki ..... B60H 1/3204 62/208
5,761,918 A 6/1998 Jackson et al.
5,775,415 A 7/1998 Yoshini et al.
5,782,610 A 7/1998 Ikeda
5,819,549 A 10/1998 Sherwood
5,896,750 A 4/1999 Karl
5,898,995 A 5/1999 Ghodbane
5,899,081 A 5/1999 Evans et al.
5,901,572 A 5/1999 Peiffer et al.
5,901,780 A 5/1999 Zeigler et al.
5,921,092 A 7/1999 Behr et al.
5,934,089 A 8/1999 Magakawa et al.
5,982,643 A 11/1999 Phlipot
5,996,363 A 12/1999 Kurachi et al.
6,016,662 A 1/2000 Tanaka et al.
6,021,043 A 2/2000 Horng
6,028,406 A 2/2000 Birk
6,029,465 A * 2/2000 Bascobert ..... B60H 1/321 62/151
6,038,877 A 3/2000 Peiffer et al.
6,038,879 A 3/2000 Turcotte
6,059,016 A 5/2000 Rafalovich et al.
6,072,261 A 6/2000 Lin
6,073,456 A 6/2000 Kawai et al.
6,111,731 A 8/2000 Cepynsky
6,112,535 A 9/2000 Hollenbeck
6,125,642 A 10/2000 Seener et al.
6,134,901 A 10/2000 Harvest et al.
6,152,217 A 11/2000 Ito et al.
6,185,959 B1 2/2001 Zajac
6,193,475 B1 2/2001 Rozek
6,205,795 B1 3/2001 Backman et al.
6,205,802 B1 3/2001 Drucker et al.
6,209,333 B1 4/2001 Bascobert
6,209,622 B1 4/2001 Lagace et al.
6,213,867 B1 4/2001 Yazici
6,230,507 B1 5/2001 Ban et al.
6,232,687 B1 5/2001 Hollenbeck et al.
6,253,563 B1 7/2001 Ewert et al.
6,265,692 B1 7/2001 Umebayahi et al.
6,276,161 B1 8/2001 Peiffer et al.
6,282,919 B1 9/2001 Rockenfeller
6,351,957 B2 3/2002 Hara
6,405,793 B1 6/2002 Ghodbane et al.
6,411,059 B2 6/2002 Frugier et al.
6,453,678 B1 9/2002 Sundhar
6,457,324 B2 10/2002 Zeigler et al.
6,467,279 B1 10/2002 Backman et al.
6,474,081 B1 11/2002 Feuerecker

(56) References Cited

U.S. PATENT DOCUMENTS 6,530,426 B1 3/2003 Kishita et al.
6,543,245 B1 4/2003 Waldschmidt
6,571,566 B1 6/2003 Temple et al.
6,575,228 B1 6/2003 Ragland et al.
6,626,003 B1 9/2003 Kortüm et al.
6,675,601 B2 1/2004 Ebara
6,684,863 B2 2/2004 Dixon et al.
6,725,134 B2 4/2004 Dillen et al.
6,745,585 B2 6/2004 Kelm et al.
6,748,750 B2 6/2004 Choi
6,758,049 B2 7/2004 Adachi et al.
6,889,762 B2 5/2005 Zeigler et al.
6,932,148 B1 8/2005 Brummett et al.
6,939,114 B2 9/2005 Iwanami et al.
6,965,818 B2 11/2005 Koenig et al.
6,981,544 B2 1/2006 Iwanami et al.
6,992,419 B2 1/2006 Kim et al.
7,135,799 B2 11/2006 Rittmeyer
7,150,159 B1 12/2006 Brummett et al.
7,246,502 B2 7/2007 Hammonds et al.
7,316,119 B2 1/2008 Allen
7,350,368 B2 4/2008 Heberle et al.
7,385,323 B2 6/2008 Takahashi et al.
7,591,143 B2 9/2009 Zeigler et al.
7,591,303 B2 9/2009 Ziegler et al.
7,614,242 B1 11/2009 Quesada Saborio
7,637,031 B2 12/2009 Salim et al.
7,765,824 B2 8/2010 Wong et al.
7,821,175 B2 10/2010 Ionel et al.
7,932,658 B2 4/2011 Ionel
8,001,799 B2 8/2011 Obayashi et al.
8,141,377 B2 3/2012 Connell
8,156,754 B2 4/2012 Hong et al.
8,276,892 B2 10/2012 Narikawa et al.
8,492,948 B2 7/2013 Wang et al.
8,517,087 B2 8/2013 Zeigler et al.
8,821,092 B2 9/2014 Nambara et al.
8,841,813 B2 9/2014 Junak et al.
8,905,071 B2 12/2014 Coombs et al.
8,919,140 B2 12/2014 Johnson et al.
8,947,531 B2 2/2015 Fischer et al.
9,157,670 B2 10/2015 Kreeley et al.
9,216,628 B2 12/2015 Self et al.
9,221,409 B1 12/2015 Gauthier
9,783,024 B2 10/2017 Connell et al.
9,878,591 B2 1/2018 Taniguchi et al.
2001/0010261 A1 8/2001 Oomura et al.
2002/0020183 A1 2/2002 Hayashi
2002/0026801 A1 3/2002 Yamashita
2002/0036081 A1 3/2002 Ito et al.
2002/0042248 A1 4/2002 Vincent et al.
2002/0078700 A1 6/2002 Kelm et al.
2002/0084769 A1 7/2002 Iritani et al.
2002/0108384 A1 8/2002 Higashiyama
2002/0112489 A1 8/2002 Egawa et al.
2002/0157412 A1 10/2002 Iwanami et al.
2002/0157413 A1 10/2002 Iwanami et al.
2003/0041603 A1 3/2003 Tada et al.
2003/0105567 A1 6/2003 Koenig et al.
2003/0106332 A1 6/2003 Okamoto
2004/0060312 A1 4/2004 Horn et al.
2004/0168449 A1 9/2004 Homan et al.
2004/0216477 A1 11/2004 Yamasaki et al.
2004/0221599 A1 11/2004 Hille et al.
2004/0250560 A1 12/2004 Ikura
2004/0256082 A1 12/2004 Bracciano
2005/0016196 A1 1/2005 Kadle et al.
2005/0109499 A1 5/2005 Iwanami et al.
2005/0161211 A1 7/2005 Zeigler et al.
2005/0230096 A1 10/2005 Yamaoka
2005/0235660 A1* 10/2005 Pham ..... F04C 28/00 62/126
2005/0257545 A1 11/2005 Ziehr et al.
2006/0042284 A1 3/2006 Heberle et al.
2006/0080980 A1 4/2006 Lee et al.
2006/0102333 A1 5/2006 Zeigler et al.
2006/0118290 A1 6/2006 Klassen et al.
2006/0151163 A1 7/2006 Zeigler et al.
2006/0151164 A1 7/2006 Zeigler et al.
2006/0254309 A1 11/2006 Takeuchi et al.
2007/0070605 A1 3/2007 Straznicky et al.
2007/0101760 A1 5/2007 Bergander
2007/0103014 A1 5/2007 Sumiya et al.
2007/0131408 A1 6/2007 Zeigler et al.
2007/0144723 A1 6/2007 Aubertin et al.
2007/0144728 A1 6/2007 Kinmartin et al.
2007/0163276 A1 7/2007 Braun et al.
2007/0227167 A1 10/2007 Shapiro
2007/0295017 A1 12/2007 Pannell
2008/0017347 A1 1/2008 Chung et al.
2008/0110185 A1 5/2008 Veettil et al.
2008/0156887 A1 7/2008 Stanimirovic
2008/0196436 A1 8/2008 Connell
2008/0196877 A1 8/2008 Zeigler et al.
2008/0209924 A1 9/2008 Yoon et al.
2009/0140590 A1 6/2009 Hung
2009/0211280 A1 8/2009 Alston
2009/0229288 A1 9/2009 Alston et al.
2009/0241592 A1 10/2009 Stover
2009/0249802 A1 10/2009 Nemesh et al.
2009/0301702 A1 12/2009 Zeigler et al.
2010/0009620 A1 1/2010 Kawato et al.
2010/0019047 A1 1/2010 Flick
2010/0127591 A1 5/2010 Court et al.
2010/0218530 A1 9/2010 Melbostad et al.
2010/0263395 A1 10/2010 Adachi et al.
2010/0293966 A1 11/2010 Yokomachi et al.
2011/0088417 A1 4/2011 Kayser
2011/0120146 A1 5/2011 Ota et al.
2011/0126566 A1 6/2011 Jones et al.
2011/0174014 A1 7/2011 Scarcella et al.
2011/0308265 A1 12/2011 Phannavong
2012/0023982 A1 2/2012 Berson et al.
2012/0102779 A1 5/2012 Beers et al.
2012/0118532 A1 5/2012 Jentzsch et al.
2012/0133176 A1 5/2012 Ramberg
2012/0247135 A1 10/2012 Fakieh
2012/0297805 A1 11/2012 Kamada et al.
2012/0318014 A1 12/2012 Huff et al.
2013/0040549 A1 2/2013 Douglas et al.
2013/0091867 A1 4/2013 Campbell et al.
2013/0145781 A1 6/2013 Liu
2013/0167577 A1 7/2013 Street
2013/0181556 A1 7/2013 Li et al.
2013/0319630 A1 12/2013 Yamamoto
2014/0066572 A1 3/2014 Corveleyn
2014/0075973 A1 3/2014 Graaf et al.
2014/0102679 A1 4/2014 Matsudaira et al.
2014/0241926 A1 8/2014 Fraser
2014/0260358 A1 9/2014 Leete et al.
2014/0290299 A1 10/2014 Nakaya
2015/0059367 A1* 3/2015 Emo ..... F25B 49/02 62/77
2015/0158368 A1 6/2015 Herr-Rathke et al.
2015/0210287 A1 7/2015 Penilla et al.
2015/0236525 A1 8/2015 Aridome
2015/0239365 A1 8/2015 Hyde et al.
2015/0306937 A1 10/2015 Kitamura et al.
2016/0089958 A1 3/2016 Powell
2016/0144685 A1 5/2016 Ochiai et al.
2016/0146554 A1 5/2016 Bhatia et al.
2016/0229266 A1 8/2016 Maeda et al.
2017/0211855 A1 7/2017 Fraser et al.
2017/0350632 A1 12/2017 Hirao

FOREIGN PATENT DOCUMENTS

CN 201872573 U 6/2011
CN 102398496 A 4/2012
CN 103547466 A 1/2014
CN 104105610 A 10/2014
CN 105071563 A 11/2015
CN 105186726 A 11/2015
DE 4440044 A1 5/1996

(56) References Cited

FOREIGN PATENT DOCUMENTS

| | | | |
|---|---|---|---|
| DE | 197 45 028 | A1 | 4/1999 |
| DE | 10014483 | A1 | 11/2000 |
| DE | 199 42 029 | A | 3/2001 |
| DE | 199 54 308 | A1 | 7/2001 |
| DE | 102005004950 | A1 | 8/2006 |
| DE | 10 2007 028851 | A1 | 12/2008 |
| DE | 102010054965 | A1 | 6/2012 |
| DE | 10 2012 022564 | A1 | 5/2014 |
| DE | 11 2015 000552 | | 11/2016 |
| EP | 0516413 | A1 | 12/1992 |
| EP | 0958952 | A1 | 11/1999 |
| EP | 1024038 | A2 | 8/2000 |
| EP | 1 400 764 | A1 | 3/2004 |
| EP | 1 477 748 | A1 | 11/2004 |
| EP | 1 700 725 | A1 | 9/2006 |
| EP | 1 703 231 | A1 | 9/2006 |
| EP | 1 970 651 | A1 | 9/2008 |
| EP | 2048011 | A1 | 4/2009 |
| EP | 2196748 | A2 | 6/2010 |
| EP | 2320160 | A1 | 5/2011 |
| EP | 2894420 | A1 | 7/2015 |
| EP | 0963895 | A2 | 12/2015 |
| EP | 3118035 | A1 | 1/2017 |
| FR | 2966391 | A1 | 4/2012 |
| JP | H02-128915 | A | 5/1990 |
| JP | 5032121 | A | 2/1993 |
| JP | H07186711 | A | 7/1995 |
| JP | H97-76740 | A | 3/1997 |
| JP | H09318177 | A | 12/1997 |
| JP | H10281595 | A | 10/1998 |
| JP | 2000108651 | A | 4/2000 |
| JP | 2005044551 | A | 4/2000 |
| JP | 2002081823 | A | 3/2002 |
| JP | 2005-033941 | A | 2/2005 |
| JP | 2005-081960 | A | 3/2005 |
| JP | 2006-264568 | A | 10/2006 |
| JP | 2008220043 | A | 9/2008 |
| JP | 2012017029 | A | 1/2012 |
| JP | 2014226979 | A | 12/2014 |
| KR | 20090068136 | A | 6/2009 |
| WO | WO 89/09143 | A1 | 10/1989 |
| WO | WO 99/61269 | | 12/1999 |
| WO | WO 00/00361 | | 1/2000 |
| WO | WO 2004/011288 | A1 | 2/2004 |
| WO | WO 2006/082082 | A1 | 8/2006 |
| WO | WO 2012/158326 | A1 | 11/2012 |
| WO | WO 2013/113308 | A1 | 8/2013 |
| WO | WO 2014/112320 | A1 | 7/2014 |
| WO | WO 2014/180749 | A1 | 11/2014 |
| WO | WO 2014/209780 | A1 | 12/2014 |
| WO | WO 2015/076872 | A1 | 5/2015 |

OTHER PUBLICATIONS

Anonymous: "NITE Connected Climate Controlled Transport Monitoring/Mobile Internet of Things UI Design/Mobil UI: Progress/Printeres/Internet of Things, User Inter . . . ," Oct. 19, 2016 retrieved from: URL:https://za.pinterest.com/pin/192810427773981541/, 1 pg.
Bergstrom, Inc. Communication Pursuant to Article 94(3), EP14722438.0, Jan. 24, 2018, 5 pgs.
Bergstrom, Inc. Corrected Extended European Search Report, EP16204259.2, dated Nov. 24, 2017, 15 pgs.
Bergstrom, Inc. Extended European Search Report, EP16204254.3, dated Jul. 25, 2017, 8 pgs.
Bergstrom, Inc. Extended European Search Report, EP16204256.8, dated Dec. 1, 2017, 13 pgs.
Bergstrom, Inc. Extended European Search Report, EP16204256.8, dated Jan. 12, 2018, 11 pgs.
Bergstrom, Inc. Extended European Search Report, EP16204259.2, dated Oct. 25, 2017, 15 pgs.
Bergstrom, Inc. Extended European Search Report, EP16204267.5, dated Jul. 11, 2017, 8 pgs.
Bergstrom, Inc. Extended European Search Report, EP18177850.7, dated Nov. 28, 2018. 8 pgs.
Bergstrom, Inc. Partial European Search Report, EP16204256.8, dated Jul. 13, 2017, 14 pgs.
Bergstrom, Inc. Partial European Search Report, EP16204259.2, dated May 30, 2017, 14 pgs.
Bergstrom, Inc., 2nd Office Action, CN201380081940.1, dated Jan. 17, 2018, 13 pgs.
Bergstrom, Inc., 2nd Office Action, CN201480027137.4, dated Jul. 13, 2017, 10 pgs.
Bergstrom, Inc., 3rd Office Action, CN201380081940.1, dated Jul. 30, 2018, 7 pgs.
Bergstrom, Inc., 3rd Office Action, CN201480027137.4, dated Jan. 17, 2018, 19 pgs.
Bergstrom, Inc., 4th Office Action, CN201480027137.4, dated Jul. 26, 2018, 8 pgs.
Bergstrom, Inc., 1st Office Action, CN201680002224.3, dated Dec. 11, 2018, 5 pgs.
Bergstrom, Inc., Communication Pursuant to Article 94(3), EP14717604.4, dated Jun. 2, 2017, 12 pgs.
Bergstrom, Inc., Communication Pursuant to Article 94(3), EP14717604.4, dated Feb. 4, 2019, 5 pgs.
Bergstrom, Inc., Communication Pursuant to Rules 161(2) and 162 EPC, EP13795064.8, dated Jun. 22, 2016, 2 pgs.
Bergstrom, Inc., Communication Pursuant to Rules 161(2) and 162 EPC, EP14717604.4, dated Oct. 23, 2015, 2 pgs.
Bergstrom, Inc., Communication Pursuant to Rules 161(2) and 162 EPC, EP14722438.0, dated Nov. 2, 2015. 2 pgs.
Bergstrom, Inc., International Preliminary Report on Patentability, PCT/US2013/068331, dated May 10, 2016, 6 pgs.
Bergstrom, Inc., International Preliminary Report on Patentability, PCT/US2014/026683, dated Sep. 15, 2015, 6 pgs.
Bergstrom, Inc., International Preliminary Report on Patentability, PCT/US2014/026687, 7 pgs.
Bergstrom, Inc., International Preliminary Report on Patentability, PCT/US2016/021602, dated Sep. 12, 2017 , 11 pgs.
Bergstrom, Inc., International Preliminary Report on Patentability, PCT/US2016/065812, dated Jun. 12, 2018, 8 pgs.
Bergstrom, Inc., International Search Report and Written Opinion, PCT/US2013/068331, dated Nov. 7, 2014, 9 pgs.
Bergstrom, Inc., International Search Report and Written Opinion, PCT/US2014/026683, dated Jul. 3, 2014 12 pgs.
Bergstrom, Inc., International Search Report and Written Opinion, PCT/US2014/026687, dated Jul. 28, 2014, 12 pgs.
Bergstrom, Inc., International Search Report and Written Opinion, PCT/US2016/021602, dated Nov. 3, 2016, 7 pgs.
Bergstrom, Inc., International Search Report and Written Opinion, PCT/US2016/065812, dated Mar. 22, 2017, 12 pgs.
Bergstrom, Inc., International Search Report and Written Opinion, PCT/US2017/021346, dated Jul. 25, 2017, 11 pgs.
Bergstrom, Inc., International Search Report and Written Opinion, PCT/US2018/044093, dated Oct. 25, 2018, 13 pgs.
Bergstrom, Inc., Office Action, CN201480027117.7, received Mar. 9, 2017, 8 pgs.
Bergstrom, Inc., Office Action, CN201480027137.4, received Mar. 3, 2017, 15 pgs.
Bergstrom, Inc., Patent Certificate, CN201480027117.7, Nov. 21, 2017, 3 pgs.
Connell, Final Office Action, U.S. Appl. No. 14/209,877, dated Jun. 22, 2016, 17 pgs.
Connell, Final Office Action, U.S. Appl. No. 14/209,877, dated Dec. 29, 2016, 21 pgs.
Connell, Final Office Action, U.S. Appl. No. 14/209,961, dated Jul. 25, 2016, 15 pgs.
Connell, Final Office Action, U.S. Appl. No. 15/064,552, dated Jun. 1, 2017, 9 pgs.
Connell, Final Office Action, U.S. Appl. No. 15/065,745, dated Dec. 17, 2018, 27 pgs.
Connell, Notice of Allowance, U.S. Appl. No. 14/209,877, dated Aug. 4, 2017, 7 pgs.
Connell, Notice of Allowance, U.S. Appl. No. 14/209,877, dated May 16, 2017, 5 pgs.

(56) References Cited

OTHER PUBLICATIONS

Connell, Notice of Allowance, U.S. Appl. No. 14/209,961, dated Jun. 15, 2017, 10 pgs.
Connell, Notice of Allowance, U.S. Appl. No. 14/965,142, dated Feb. 26, 2018, 8 pgs.
Connell, Notice of Allowance, U.S. Appl. No. 14/995,119, dated Aug. 31, 2017, 7 pgs.
Connell, Notice of Allowance, U.S. Appl. No. 15/280,876, dated Jun. 21, 2018, 8 pgs.
Connell, Notice of Allowance, U.S. Appl. No. 15/791,243, dated Jan. 24, 2019, 7 pgs.
Connell, Office Action, dated Oct. 19, 2018, U.S. Appl. No. 15/722,860, 7 pgs.
Connell, Office Action, U.S. Appl. No. 15/283,150, dated Sep. 27, 2018, 21pgs.
Connell, Notice of Allowance, U.S. Appl. No. 15/283,150, dated Mar. 22, 2019, 8 pgs.
Connell, Office Action, U.S. Appl. No. 14/209,877, dated Nov. 27, 2015, 19 pgs.
Connell, Office Action, U.S. Appl. No. 14/209,961, dated Dec. 2, 2015, 14 pgs.
Connell, Office Action, U.S. Appl. No. 14/965,142, dated Aug. 29, 2017, 12 pgs.
Connell, Office Action, U.S. Appl. No. 15/065,745, dated May 31, 2018 44 pgs.
Connell, Office Action, U.S. Appl. No. 15/280,876, dated Dec. 14, 2017, 23 pgs.
Connell, Office Action, U.S. Appl. No. 15/791,243, dated May 8, 2018, 12 pgs.
FlatPlate Heat Exchangers; GEA FlatPiate Inc.; website—http://www.flatplate.com/profile.html; date last visited Aug. 9, 2007; 3 pages.
Frank Stodolsky, Linda Gaines, and Anant Vyas; Analysis of Technology Options to Reduce the Fuel Consumption of Idling Trucks; Paper-Center for Transportation Research, Energy Systems Division, Argonne National Laboratory,9700 South Cass Avenue, Argonne, Illinois 60439;Jun. 2000; 30 pages.
Glacier Bay Inc., Company History, pages printed from a website, http://web.archive.org/web/20000301153828/www .g!acierbay.corn/History:.htrn, apparent archive date: Mar. 1, 2000; 2 pages.
Glacier Bay Inc., Contact, page printed from a website, httQ://web.archive.orq/web/19990508104511/W \'"I !V .qlacierba:t.com/Contact.htm, apparent archive date: May 8, 1999; 1 page.
Glacier Bay Inc., Darpa/Glacier Bay ECS, pages printed from a website, http://web.archive.org/web/19991104132941/wvvw .glacierbay.com/darQatxt. htm, apparent archive date: Nov. 4, 1999, 2 pages.
Glacier Bay Inc., Glacier Bay ECS DARPA Project—Final Report, pages printed from a website, http://web.archive.or_gjweb/19991103001512/v•vww g.Jacierbay.com/Darnhtm.htm, apparent archive date: Nov. 3, 1999, 9 pages.
Glacier Bay Inc., Glacier Bay ECS DARPA Project—Operational Video, page printed from a website, http://web.archive.orq/web/19991022221040/wvvw .qlacierbay.com/DarQvid.htm, apparent archive date Oct. 22, 1999; 1 page.
Glacier Bay Inc., Glacier Bay ECS DARPA Project—Project Photos, pages printed from a website, http://web.archive.org/web/1999"1103012854/www .glacierbay.com/Dargghotos.htm, apparent archive date: Nov. 3, 1999, 2 pages.
Glacier Bay Inc., Glacier Bay's Home Page, page printed from a website, http(?:i/web.archive.org/web/19990417062255/htt[2://www.glacierbay.com/, apparent archive date: Apr. 17, 1999, 1 page.
Glacier Bay Inc., R & D, pages printed from a website, http://web.archive.org/web/20000121130306/www.glacierbay.com/R&D.htm, apparent archive date: Jan. 21, 2000, 2 pages.
Hansson, Office Action dated Oct. 5, 2018, U.S. Appl. No. 15/256,109, 14 pgs.
Mahmoud Ghodbane; On Vehicle Performance of a Secondary Loop A/C System; SAE Technical Paper Series 2000-01-1270; SAE 2000 World Congress, Detroit, Michigan; Mar. 6-9, 2000; 6 pages.
Masami Konaka and Hiroki Matsuo; SAE Technical Paper Series 2000-01-1271; SAE 2000 World Congress, Detroit, Michigan; Mar. 6-9, 2000; 6 pages.
Mayo Mayo, Final Office Action, U.S. Appl. No. 15/034,517, dated Aug. 28, 2018, 9pgs.
Mayo Mayo, Final Office Action, U.S. Appl. No. 15/034,517, dated Nov. 30, 2018, 7 pgs.
Mayo Mayo, Office Action, U.S. Appl. No. 15/034,517, dated Feb. 21, 2018, 22 pgs.
Michael Löhle, Günther Feuerecker and Ulrich Salzer; Non Idling HVAC-modufe tor Long Distance Trucks;SAE TechnicalPaper Series 1999-01-1193; International Congress and Exposition, Detroit, Michigan; Mar. 1-4, 1999; 8 pages.
Packless Industries, the leader in refrigerant to water coaxial heat exchangers, flexible hoses and sucti . . . ; website—http://www.packless.com/profile.htmle: date last visited Aug. 9, 2007; 1 page.
Paper No. 26 in IPR2012-00027, Jun. 11, 2013, 12 pgs. (U.S. Pat. No. 7,591,303).
Patricia Gardie and Vincent Goetz; Thermal Energy Storage System by Solid Absorption for Electric Automobile Heating and Air-Conditioning; Paper; 5 pages.
TropiCool No-idle Heating & Cooling, 110V/12V High-efficiency, Self-contained, Electrified Heating/AC System; ACC Climate Control Brochure, Elkhart, Indiana; 205, 1 page.
TropiCool Power Plus, More comfort. More efficiency. More options.; ACC Climate Control Brochure, Elkhart, Indiana; 2006, 3 pages.
Zeigler, Final Office Action, U.S. Appl. No. 13/661,519, dated Sep. 18, 2013, 15 pgs.
Zeigler, Final Office Action, U.S. Appl. No. 13/661,519, dated Sep. 26, 2014, 23 pgs.
Zeigler, Notice of Allowance, U.S. Appl. No. 13/661,519, dated Jun. 17, 2016, 8 pgs.
Zeigler, Office Action, U.S. Appl. No. 13/661,519, dated Apr. 9, 2014, 20 pgs.
Zeigler, Office Action, U.S. Appl. No. 13/661,519, dated Mar. 11, 2013, 8 pgs.
Zeigler, Office Action, U.S. Appl. No. 13/661,519, dated Oct. 28, 2015, 20 pgs.
Bergstrom, Inc., International Search Report and Written Opinion, PCT/US2017049859, dated Nov. 12, 2017, 4 pgs.
Bergstrom, Inc., International Preliminary Report on Patentability, PCT/US2017049859, dated Mar. 5, 2019, 6 pgs.
Bergstrom, Inc., International Search Report and Written Opinion PCT/US2017053196, dated Sep. 3, 2018, 17 pgs.
Bergstrom, Inc., International Preliminary Report on Patentability, PCT/US2017053196, dated Apr. 2, 2019, 11 pgs.
Bergstrom, Inc., International Search Report and Written Opinion PCT/US2016/423326, dated Sep. 27, 2016, 8 pgs.
Bergstrom, Inc., International Preliminary Report on Patentability PCT/US2016/423326, dated Jan. 16, 2018, 7 pgs.
Bergstrom, Inc., International Search Report and Written Opinion PCT/US2016/42307, dated Oct. 7, 2016, 8 pgs.
Bergstrom, Inc., International Preliminary Report on Patentability PCT/US2016/42307, dated Jan. 16, 2018, 7 pgs.
Bergstrom, Inc., International Search Report and Written Opinion PCT/US2016/42314, dated Sep. 30, 2016, 7 pgs.
Bergstrom, Inc., International Preliminary Report on Patentability, PCT/US2016/42314, dated Jan. 16, 2018, 6 pgs.
Bergstrom, Inc., International Search Report and Written Opinion PCT/US2016/42329, dated Sep. 30, 2016, 6 pgs.
Bergstrom, Inc., International Preliminary Report on Patentability PCT/US2016/42329, dated Jan. 16, 2018, 5 pgs.
Bergstrom, Inc., Communication Pursuant to Article 94(3), EP16820096.2, dated Aug. 12, 2019, 7 pgs.
Bergstrom, Inc., Communication Pursuant to Rules 161(1) and 162, EP17780954.8, dated May 10, 2019, 3 pgs.
Bergstrom, Inc., Extended European Search Report, EP19166779.9, dated Aug. 30, 2019, 8 pgs.
Bergstrom, Inc., Patent Certificate CN201480027137.4, May 31, 2019, 4 pgs.
Connell, Office Action, U.S. Appl. No. 15/065,745, dated May 9, 2019, 28 pgs.

(56) References Cited

OTHER PUBLICATIONS

Connell, Notice of Allowance, dated Feb. 7, 2019, U.S. Appl. No. 15/722,860, 5 pgs.
Connell, Notice of Allowance, dated May 20, 2019, U.S. Appl. No. 15/722,860, 5 pgs.
Connell, Notice of Allowance, U.S. Appl. No. 15/791,243, dated May 15, 2019, 7 pgs.
Hansson, Final Office Action, U.S. Appl. No. 15/256,109, dated May 2, 2019, 14 pgs.
TYCO Electronics Corporation, "MAG-MATE Connector with Multispring Pin," Datasheet, 2013, pp. 1-2 from <URL: http://datasheet.octopart.com/1247003-2-TE-Connectivity-datasheet-14918754.pdf>.

* cited by examiner

108

REFRIGERATION SYSTEM WITH SUPERHEATING, SUB-COOLING AND REFRIGERANT CHARGE LEVEL CONTROL

RELATED APPLICATIONS

This application is a continuation of U.S. application Ser. No. 14/995,119, filed Jan. 13, 2016, entitled "Refrigeration System with Superheating, Sub-Cooling and Refrigerant Charge Level Control," which is hereby incorporated by reference in its entirety.

FIELD OF THE INVENTION

The present invention generally relates to refrigeration systems and control methods for such systems. More particularly, the present invention relates to refrigeration systems and methods that determine the refrigerant charge level and/or refills the refrigerant when the refrigerant charge level is below a predetermined level.

BACKGROUND

The refrigerant level in a refrigeration system depends on a number of factors, including the configuration of the refrigeration system, the initial refrigerant level in the refrigeration system, any sub-cooling or super-heating that occurs during the operation of the refrigeration system, and the temperature and humidity of the environment where the refrigeration system is used. To ensure that a refrigeration system is operating efficiently and safely, it is essential to maintain the refrigerant in the refrigeration system at a proper level during operation.

Conventional refrigeration systems and methods focus on determination of whether the refrigerant in the systems is below or above an acceptable refrigerant charge level. Some of them focus on development of algorithms to more accurately determine the refrigerant charge level. Such conventional refrigeration systems and methods do not provide solutions to resolve the problems after it is determined that the refrigerant charge level is below an acceptable level.

The information disclosed in this Background section is provided solely to provide a general background of the embodiments described herein and is not an acknowledgement or suggestion that this information forms part of the prior art already known to a person skilled in the art.

SUMMARY

Various aspects of the present invention provide refrigeration systems and control methods that can not only determine the refrigerant charge level, but can also predict when the refrigerant charge level is getting low, and, in some embodiments, refill the refrigerant when the refrigerant charge level is below a proper refrigerant charge level.

In one embodiment, a refrigeration system includes a compressor, a condenser, an evaporator, an assembly, and refrigerant lines fluidly connecting the compressor, the condenser, the evaporator and the assembly to form a refrigerant circuit for circulating the refrigerant. The compressor compresses a refrigerant. The condenser, disposed downstream of the compressor, condenses the refrigerant. The evaporator, disposed downstream of the condenser, vaporizes the refrigerant. The assembly includes a receiver drier unit disposed between the condenser and the evaporator, or an accumulator unit disposed between the evaporator and the compressor, or both the receiver drier unit and the accumulator unit. The receiver drier unit includes a receiver drier and a first sensor. The receiver drier is configured to temporarily store the refrigerant or absorb moisture from the refrigerant or both. The first sensor is installed at the receiver drier to measure temperature and pressure of the refrigerant after it has passed through the condenser. The accumulator unit includes an accumulator and a second sensor. The accumulator is configured to restrict liquid refrigerant from entering the compressor. The second sensor is installed at the accumulator to measure temperature and pressure of the refrigerant after it has passed through the evaporator. The refrigeration system further includes a controller electrically connected to the assembly. The controller is configured to perform one or more of the following: determine a sub-cooling level based on the temperature and pressure measured by the first sensor, determine a super-heating level based on the temperature and pressure measured by the second sensor, and determine a refrigerant charge level based at least in part on the determined sub-cooling level or the determined super-heating level.

In some embodiments, the assembly further includes an electronic valve fluidly connected to a refrigerant reservoir. The electronic valve is installed at the receiver drier or at the accumulator or fluidly connected to the refrigerant circuit at a location other than the receiver drier unit or the accumulator unit. The electronic valve is selectively operated to allow flow of the refrigerant from the refrigerant reservoir to the refrigerant circuit. The flow of the refrigerant from the refrigerant reservoir to the refrigerant circuit is driven by pressure difference between the refrigerant reservoir and where the electronic valve is installed. As such, the refrigerant charge level is maintained above a predetermined refrigerant charge level.

In some embodiments, the refrigerant system further includes one or more of the following: a first air blower electrically coupled to the controller, positioned proximate the condenser and configured to blow ambient air or air from an air intake of the engine over the condenser; a metering device disposed upstream of the evaporator and configured for controlling flow of the refrigerant into the evaporator; and a flow control valve disposed upstream of the compressor and configured to selectively restrict or permit flow of the refrigerant to the compressor.

In some embodiments, the sub-cooling level is determined using a look-up table in accordance with the temperature and pressure measured by the first sensor. The super-heating level is determined using a look-up table in accordance with the temperature and pressure measured by the second sensor. The refrigerant charge level is calculated based at least in part on the determined sub-cooling level or the determined super-heating level.

In some embodiments, the controller performs other additional or optional functions. In one case, the controller predicts whether and when a failure, in which the refrigerant charge level is below a predetermined refrigerant level, is likely to occur by extrapolating the determined refrigerant charge levels over time or by considering one or more of the following: a trend of the determined refrigerant charge levels over time, exterior temperature, interior temperature and humidity. In other embodiments, the controller predicts how long the refrigerant will last based on one or more of the determined sub-cooling levels over time and the determined super-heating levels over time. In yet other embodiments, the controller calculates a compression ratio of the compressor, determines whether a blockage occurs in the refrigerant circuit based on the calculated compression ratio, and determines a location of the blockage, if a blockage has occurred, based at least in part on the determined sub-cooling level and the determined super-heating level. In yet other embodiments, the controller is electrically connected to the compressor, counts clutch cycles of the compressor and predicts clutch life of the compressor based on one or more of the following: the clutch cycles, clutch temperature and current.

In some embodiments, the controller is electrically or wirelessly coupled to an electronic device and outputs one or more signals to the electronic device, such as determined sub-cooling, super-heating and/or refrigerant charge levels, warning signals and maintenance request.

Another embodiment provides a first method for controlling a refrigeration system. The first method includes: (a) obtaining a refrigerant sub-cooling level based on the temperature and pressure of the refrigerant measured by the first sensor, and a refrigerant super-heating level based on the temperature and pressure of the refrigerant measured by the second sensor; (b) calculating a refrigerant charge level based at least in part on the refrigerant sub-cooling level and the refrigerant super-heating level; (c) determining whether the refrigerant charge level is below a predetermined refrigerant charge level; and (d) selectively controlling the electronic valve, if it is determined that the refrigerant charge level is below the predetermined refrigerant charge level, to allow flow of the refrigerant from the refrigerant reservoir to the refrigerant circuit of the refrigeration system, thereby raising the refrigerant charge level to above the predetermined refrigerant charge level.

In some embodiments, the first method further includes one or more additional or optional processes. In one case, prior to obtaining a refrigerant sub-cooling level, the first method further includes one or more of the following: installing a first sensor at the receiver drier to measure temperature and pressure of the refrigerant after it has passed through the condenser; installing a second sensor at the accumulator to measure temperature and pressure of the refrigerant after it has passed through the evaporator; and installing an electronic valve in the refrigerant circuit, wherein the electronic valve is fluidly connected to a refrigerant reservoir. In another case, the first method further includes one or more of the following: predicting whether and when a failure (e.g., the refrigerant charge level is below a predetermined refrigerant level) is likely to occur; predicting how long the refrigerant will last; determining where a blockage occurs in the refrigerant circuit and a location of the blockage; predicting clutch life of the compressor; and output a signal or signals to an electronic device.

Other embodiments provide a second method for controlling a refrigeration system. The second method includes: (a) installing a receiver drier unit in the refrigerant circuit between the condenser and the evaporator, wherein the receiver drier unit comprises a receiver drier and a first sensor installed at the receiver drier to measure temperature and pressure of the refrigerant after it has passed through the condenser; (b) installing an accumulator unit in the refrigerant circuit between the evaporator and the compressor, wherein the accumulator unit comprises an accumulator and a second sensor installed at the accumulator to measure temperature and pressure of the refrigerant after it has passed through the evaporator; (c) obtaining a refrigerant sub-cooling level based on the temperature and pressure of the refrigerant measured by the first sensor, and a refrigerant super-heating level based on the temperature and pressure of the refrigerant measured by the second sensor; (d) calculating a refrigerant charge level based at least in part on the refrigerant sub-cooling level and the refrigerant super-heating level; and (e) determining one or more of the following: whether the refrigerant sub-cooling level is within a predetermined refrigerant sub-cooling range; whether the refrigerant super-heating level is within a predetermined refrigerant super-heating range; and whether the refrigerant charge level is below a predetermined refrigerant charge level.

The refrigeration systems and methods of the present invention have other features and advantages that will be apparent from or are set forth in more detail in the accompanying drawings, which are incorporated herein, and the following Detailed Description, which together serve to explain certain principles of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Figure 1:
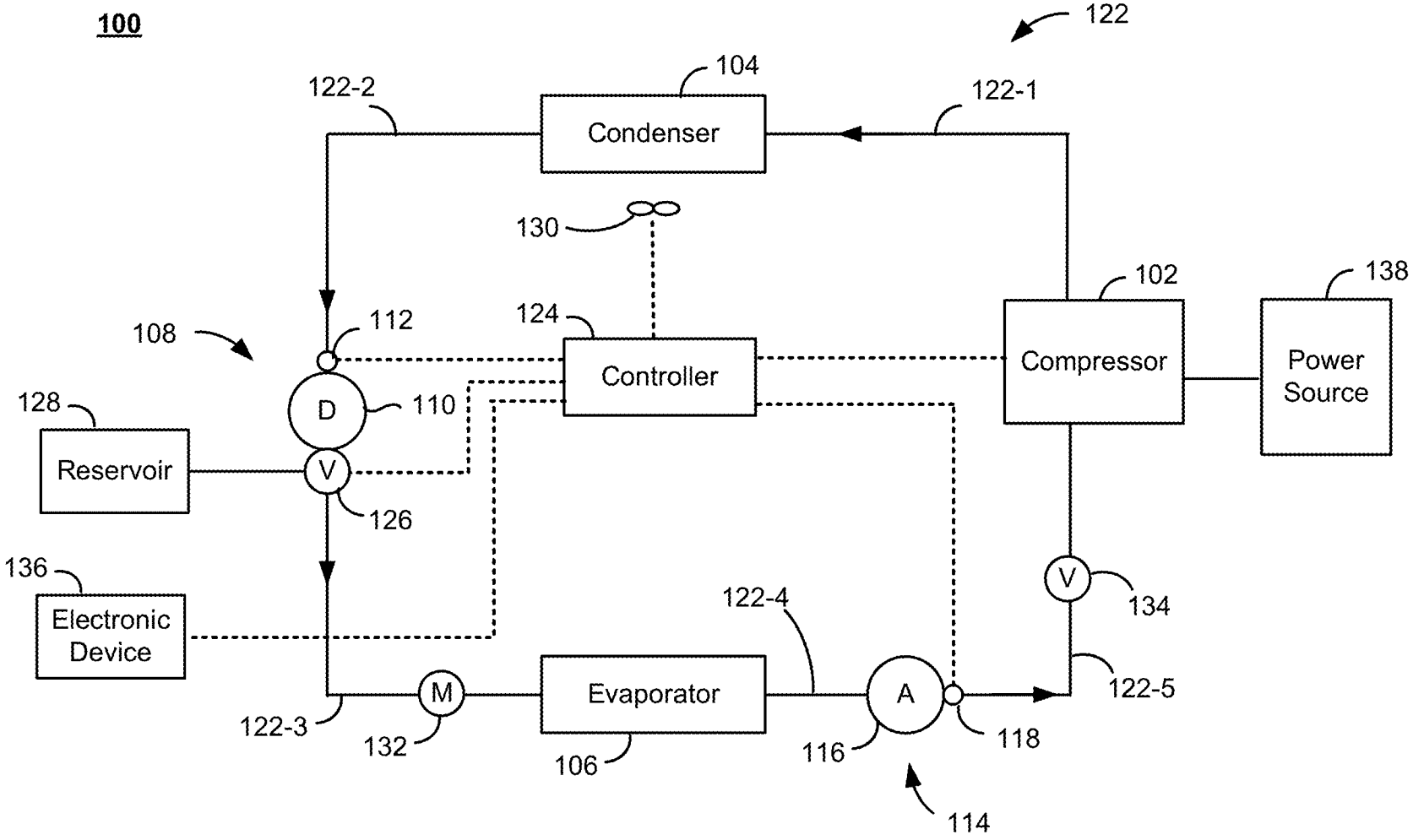
FIG. 1 is a block diagram illustrating a refrigeration system in accordance with some embodiments of the present invention.

Reference will now be made in detail to implementations of the present application as illustrated in the accompanying drawings. The same reference indicators will be used throughout the drawings and the following detailed description to refer to the same or like parts. Those of ordinary skill in the art will realize that the following detailed description of the present application is illustrative only and is not intended to be in any way limiting. Other embodiments of the present application will readily suggest themselves to such skilled persons having benefit of this disclosure.

In the interest of clarity, not all of the routine features of the implementations described herein are shown and described. It will, of course, be appreciated that in the development of any such actual implementations, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of this disclosure can be made without departing from its spirit and scope, as will be apparent to those skilled in the art. The specific embodiments described herein are offered by way of example only, and the disclosure is to be limited only by the terms of the appended claims, along with the full scope of equivalents to which such claims are entitled.

Embodiments of the present invention are described in the context of refrigeration systems and methods for controlling the refrigeration systems. A refrigeration system of the present invention in general includes a compressor, a condenser, an evaporator and refrigerant lines fluidly connecting the compressor, condenser and evaporator to form a refrigerant circuit. In many cases, the refrigeration system also includes a receiver drier unit and/or an accumulator unit disposed in the refrigerant circuit and integrated with a transducer to measure the temperature and pressure of the refrigerant. In some cases, a controller is included in the refrigeration system and a novel method is used to (i) monitor the sub-cooling, super-heating and/or refrigerant charge levels, and (ii) inform an operator whether and/or when a failure (e.g., the refrigerant charge level is below a predetermined refrigerant level) is likely to occur. In some cases, the refrigeration system further includes an electronic valve fluidly connected to a refrigerant reservoir, which the controller (or another controller) selectively opens or closes so that the refrigerant in the refrigeration system is maintained above a predetermined refrigerant charge level.

The refrigeration systems of the present invention can be used in various applications such as in a vehicle for cooling a compartment of the vehicle. The vehicle includes, but is not limited to, cars, vans, trucks, buses, and trailers. In some cases, the refrigeration systems are used in conjunction with or integrated with existing A/C refrigeration systems. In some embodiments, the refrigeration systems share some common components, for instance, compressors, condensers or evaporators, with existing A/C refrigeration system(s). In some cases, the refrigeration systems are constructed by modifying existing A/C refrigeration systems, for instance, by installing a receiver drier unit and/or an accumulator unit of the present invention into the existing A/C refrigeration system(s).

By way of illustration, FIG. 1 depicts a refrigeration system (100) including a compressor (102), a condenser (104), an evaporator (106), an assembly, and refrigerant lines fluidly connecting the compressor (102), condenser (104), evaporator (106) and assembly to form a refrigerant circuit for circulating the refrigerant. In some cases, the assembly includes both a receiver drier unit (108) and an accumulator unit (114). In some cases, the assembly includes only one of the receiver drier unit (108) and the accumulator unit (114). As an example, FIG. 1 illustrates the assembly including both the receiver drier unit (108) and an accumulator unit (114). In the illustrated embodiment, the condenser (104) is disposed downstream of the compressor (102) and fluidly connected to the compressor (102) by a refrigerant line (e.g., 122-1). The receiver drier unit (108) is disposed downstream of the condenser (104) and fluidly connected to the condenser (104) by a refrigerant line (e.g., 122-2). In some cases, the receiver drier unit (108) includes a receiver drier (110) and a first sensor (112). The evaporator (106) is disposed downstream of the receiver drier unit (108) and fluidly connected to the receiver drier unit (108) by a refrigerant line (e.g., 122-3). The accumulator unit (114) is disposed downstream of the evaporator (106) and fluidly connected to the evaporator (106) by a refrigerant line (e.g., 122-4) and to the compressor (102) by a refrigerant line (e.g., 122-5), thus forming a refrigerant circuit for circulating the refrigerant. In some cases, the accumulator unit (114) includes an accumulator (116) and a second sensor (118).

The first and second sensors (112, 118) can be any type of sensors suitable to measure temperature and pressure of the refrigerant, including but not limited to combined pressure and temperature transducers. In some cases, the first sensor (112) includes a first temperature sensor and a first pressure sensor; the second sensor (118) includes a second temperature sensor and a second pressure sensor. The first sensor (112) is disposed on the high pressure side of the refrigerant circuit, and preferably installed at the receiver drier (110) such as at the inlet, outlet, interior or other suitable location of the receiver drier (110). The second sensor (118) is disposed on the low pressure side of the refrigerant circuit, and preferably installed at the accumulator (116) such as at the inlet, outlet, interior or other suitable location of the accumulator (116). Having the first sensor (112) installed at the receiver drier (110) and/or the second sensor (118) at the accumulator (116) provides several advantages, including packaging and installation convenience, original equipment time saving, and easier leakage testing.

During operation of the refrigeration system, the compressor (102) compresses a refrigerant into a compressed refrigerant. The compressor (102) can be any type of compressor including but not limited to a reciprocating compressor or rotary compressor. The compressor (102) is driven by a power source (138) such as a solar cell, an electrical battery, an alternator, or may be belt driven from an internal combustion engine if the refrigeration system is used in a vehicle. The condenser (104) condenses the refrigerant that has been compressed by the compressor (102). The receiver drier (110) of the receiver drier unit (108) temporarily stores the refrigerant and/or absorbs moisture, debris or other undesirable substances from the refrigerant that has been condensed by the condenser (104). The first sensor (112) measures temperature and pressure of the refrigerant that has been condensed by the condenser (104). The evaporator (106) vaporizes or evaporates the refrigerant that has been condensed by the condenser (104), providing cooling for desired use. The accumulator (116) restricts liquid refrigerant from entering the compressor (102), for example by temporarily storing excess liquid refrigerant at the accumulator (116), to prevent damage to the compressor (102). The second sensor (118) measures temperature and pressure of the refrigerant that has been vaporized/evaporated by the evaporator (106). It should be noted that depending on the operation and performance of the refrigeration system, the condensed refrigerant at the receiver drier (110) and the vaporized/evaporated refrigerant at the accumulator (116) can be in the form of a liquid, a vapor, or a mixture of liquid and vapor.

In many embodiments, the refrigeration system (100) also includes a controller (124) electrically coupled to one or more components of the refrigeration system and configured to monitor and control the amount of the refrigerant entering into the evaporator (106), the amount of the refrigerant entering the compressor (102), the refrigerant level in the refrigeration system, and/or other operations. For instance, in the illustrated embodiment, the controller (124) is electrically connected to the assembly, in particular, connected to the first sensor (112) of the receiver drier unit (108) and the second sensor (118) of the accumulator unit (114). The controller (124) determines a sub-cooling level based on the temperature and pressure measured by the first sensor (112), a super-heating level based on the temperature and pressure measured by the second sensor (118), and/or a refrigerant charge level based at least in part on the determined sub-cooling level or the determined super-heating level. In some cases, the controller (124) is mounted on or integrated with the receiver drier (110) or the accumulator (116).

As used herein, "sub-cooling" refers to a condition where the temperature of a liquid refrigerant is lower than the saturation temperature required to keep the liquid refrigerant from changing into a gas phase, or a liquid existing at a temperature below its normal saturation temperature. As used herein, "sub-cooling level" refers to an amount of sub-cooling at a given condition (e.g., at a particular pressure), and in some cases, it is the difference between the saturation temperature at the given condition and the actual liquid refrigerant temperature measured by the first sensor. In some embodiments, sub-cooling level is determined by converting the pressure measured by the first sensor to a temperature using a pressure-temperature (PT) chart or table and then subtracting that temperature from the temperature measured by the first sensor. In some embodiments, the sub-cooling level is determined using a look-up table in accordance with the temperature and pressure measured by the first sensor. In some cases, the look-up table is stored in a memory associated with the controller.

As used herein, "super-heating" refers to a condition where the temperature of a vapor refrigerant is higher than the saturation temperature at a particular pressure, or heating a liquid under pressure above its boiling point without vaporization. As used herein, "super-heating level" refers to an amount of super-heating at a given condition, and in some cases, it is the difference between the saturation temperature at the given condition and the actual vapor refrigerant temperature measured by the second sensor. In some embodiments, super-heating level is determined by converting the pressure measured by the second sensor to a temperature using a PT chart or table and then subtracting that temperature from the temperature measured by the second sensor. In some embodiments, the super-heating level is determined using a look-up table in accordance with the temperature and pressure measured by the second sensor. In some cases, the look-up table is stored in a memory associated with the controller.

As used herein, "refrigerant charge level" refers to an amount of refrigerant contained in the refrigeration system, and "predetermined refrigerant charge level" refers to a predetermined amount of refrigerant for the refrigeration system to operate efficiently and safely. In most cases, the predetermined refrigerant charge level depends on the design and configuration of the refrigeration system and can be determined prior to the use of the refrigeration system. Maintaining the refrigerant at or above the predetermined refrigerant charge level during the operation of refrigeration system is essential for the refrigeration system to operate efficiently and safely.

In some embodiments, the refrigeration system further includes an electronic valve (126) to inject refrigerant from a refrigerant reservoir (128) into the refrigeration system when the refrigerant charge level is below a predetermined refrigerant charge level. IN some embodiments, control of the electronic valve is controlled by the controller. As such, the refrigeration system can continue functioning properly for some additional period of time, allowing an operator to schedule a maintenance appointment or take other appropriate actions. The electronic valve (126) can be integrated with the assembly, e.g., installed at the receiver drier (110) or at the accumulator (116), or fluidly connected to the refrigerant circuit at a location other than the receiver drier unit (108) or the accumulator unit (114). As an example, FIG. 1 illustrates the electronic valve (126) installed at the receiver drier (110).

The electronic valve (126) is selectively operated to allow flow of the refrigerant from the refrigerant reservoir (128) to the refrigerant circuit. Operation of the electronic valve (126) can be automatic or manual. For example, in some cases, the controller (124) is electrically connected to the electronic valve (126) and controls the electronic valve (126) to be selectively opened when the refrigerant charge level is low (e.g., below a predetermined refrigerant charge level) or closed when the refrigerant charge level is normal (e.g., above the predetermined refrigerant charge level). In an embodiment where the electronic valve is installed at the receiver drier, when the electronic valve is opened, the refrigerant flows from the refrigerant reservoir to the refrigerant circuit, driven by the pressure difference between the refrigerant reservoir and the receiver drier. In an embodiment where the electronic valve is installed at the accumulator, when the electronic valve is opened, the refrigerant flows from the refrigerant reservoir to the refrigerant circuit, driven by the pressure difference between the refrigerant reservoir and the accumulator. In an embodiment where the electronic valve is directly connected to the refrigerant circuit, when the electronic valve is opened, the refrigerant flows from the refrigerant reservoir to the refrigerant circuit, driven by the pressure difference between the refrigerant reservoir and the refrigerant circuit at the location where the electronic valve is fluidly connected. As such, the refrigerant charge level in the refrigeration system is maintained above a predetermined refrigerant charge level, allowing the refrigeration system to operate safely and efficiently and allowing time for an operator or others to schedule a maintenance appointment or take other proper actions.

In some embodiments, the controller (124) performs additional or optional functions. For instance, in an embodiment, the controller (124) is configured to predict how long the refrigerant will last based on the sub-cooling level over time, the super-heating level over time, the refrigerant charge level, and/or other factors such as temperature and humidity inside and outside of the place where the refrigeration system is used (e.g., a vehicle). Sub-cooling and super-heating levels depend on ambient conditions and thermal load on the refrigeration system, and are unique for each set of given conditions including ambient conditions and thermal load on the refrigeration system. By monitoring the sub-cooling level and/or super-heating over time, the system is able to predict a refrigerant leakage rate severity (if any) and how long the system can run before service is required.

In another embodiment, the controller (124) is configured to predict whether a failure, in which the refrigerant charge level is below a predetermined refrigerant charge level, is likely to occur. Generally, a refrigeration system has an initial charge level, and learns how the refrigeration system operates and then is able to tell whether a charge level is low over time. In some cases, the controller uses the obtained super-heating level and sub-cooling in conjunction with power and ambient conditions to determine whether the refrigeration system is performing correctly. Then based on the normal operation "learned" over time, the controller determines whether the refrigerant charge level is low, e.g., below a predetermined refrigerant charge level. In some cases, the controller examines the trend of the refrigerant charge level over time and extrapolates the refrigerant charge level to predict how long the refrigerant will last and/or when the refrigerant charge level is likely to be below the predetermined refrigerant level.

In still another embodiment, the controller (124) is configured to calculate a compression ratio of the compressor (102). If the calculated compression ratio exceeds a specific compression ratio for a given condition, the controller (124) determines that a blockage occurs in the refrigerant circuit. The controller (124) then examines the sub-cooling level, the super-heating level and/or other factors to determine the location of the blockage. For instance, abnormal sub-cooling level indicates a blockage in the condenser (104) and abnormal super-cooling indicates a blockage in the evaporator (106).

In a further embodiment, the controller (124) is electrically connected to the compressor (102). The controller (124) is configured to count clutch cycles of the compressor (102) and predict clutch life of the compressor (102) based on the clutch cycles, clutch temperature, current and/or other factors.

In some embodiments, the controller (124) is electrically or wirelessly coupled to an electronic device (136) including but not limited to a display, a receiver, a smartphone or a computer. The electronic device (136) can be located in the same place as the refrigeration system. For instance, the refrigeration system is installed in a vehicle and the electronic device (136) is a display on the dashboard of the vehicle. The electronic device (136) can also be located remotely from the refrigeration system. For instance, the refrigeration system is installed in a vehicle whereas the electronic device (136) is a device not directly associated with the vehicle such as a personal smartphone or a computer at a dealer.

The controller (124) outputs one or more signals to the electronic device (136). The signals can be audio such as a beep or visual such a text or graphic displayed on a screen. The signals include but are not limited to data (e.g., the cooling level, the super-heating level and the refrigerant charge level), warning signals (e.g., the refrigerant charge level is below a predetermined refrigerant charge level), maintenance request or the like.

In some cases, the controller (124) outputs a warning signal if one or more of the following occur: when one or more of the following occurs: the sub-cooling level is outside of a predetermined sub-cooling range, the super-heating level is outside of a predetermined super-heating range, the refrigerant charge level is below a predetermined refrigerant charge level, the compression ratio is above a specific level for a given condition, a blockage has occurred, or a cooling efficiency of the refrigeration system is below a predetermined cooling efficiency. In some cases, the controller (124) outputs a warning signal if one or more of the following occur: the determined sub-cooling level is outside of a predetermined sub-cooling range for a first predetermined period of time, the determined super-heating level is outside of a predetermined super-heating range for a second predetermined period of time, the refrigerant charge level is below a predetermined refrigerant charge level for a third predetermined period of time. It should be noted that the predetermined sub-cooling range, the predetermined super-heating range, the predetermined refrigerant charge level, the specific level for the compression level and other parameters depend on refrigeration system's configuration and design, and can be determined prior to the use of the refrigeration system.

In some embodiments, the refrigeration system includes one or more additional or optional components such as air blowers, metering devices, flow control valves, or the like. By way of illustration, FIG. 1 illustrates the refrigeration system including a first air blower (130) electrically coupled to the controller (124) and positioned proximate the condenser (104). The first air blower (130) is configured to blow ambient air or air from an air intake of the engine over the condenser (104). The amount of airflow over the condenser (104) affects the temperature and pressure of the refrigerant at the high pressure side of the refrigerant circuit and hence the efficiency of the refrigeration system. Accordingly, in some cases, to enhance the efficiency of the refrigeration system, the controller (124) controls a speed of the first air blower (130) based at least in part on the temperature measured by the first sensor (112), the pressure measured by the first sensor (112), the temperature measured by the second sensor (118), and/or the pressure measured by the second sensor (118).

The refrigeration system as illustrated in FIG. 1 also includes a metering device (132) disposed upstream of the evaporator (106) and configured for controlling flow of the refrigerant into the evaporator (106). In some cases, the metering device (132) is a thermal expansion valve or a capillary tube. In some cases, the refrigeration system further includes a flow control valve (134) disposed upstream of the compressor (102) and configured to selectively restrict or permit flow of the refrigerant to the compressor (102).

Figure 2C:
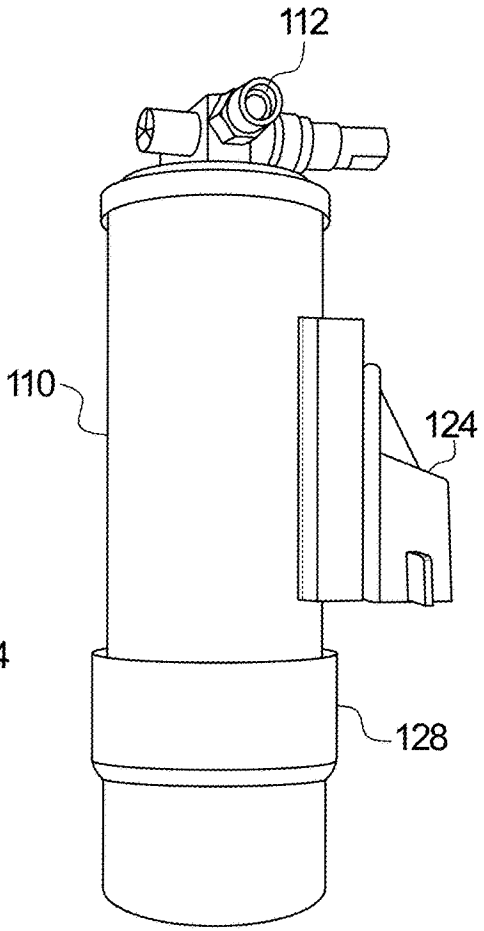
FIGS. 2A, 2B and 2C illustrate a receiver drier unit of a refrigeration system in accordance with some embodiments of the present invention.
Figure 2B:
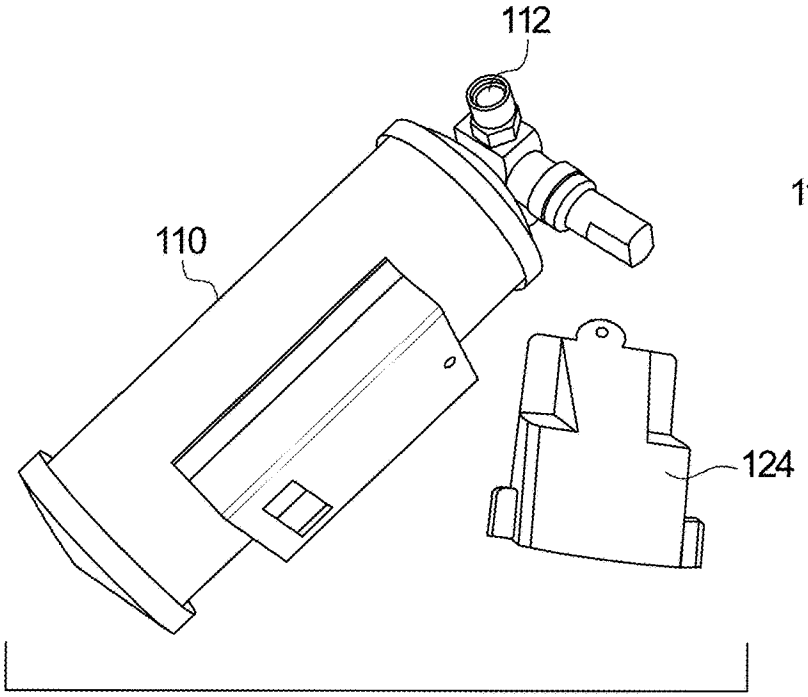
Figure 2A:
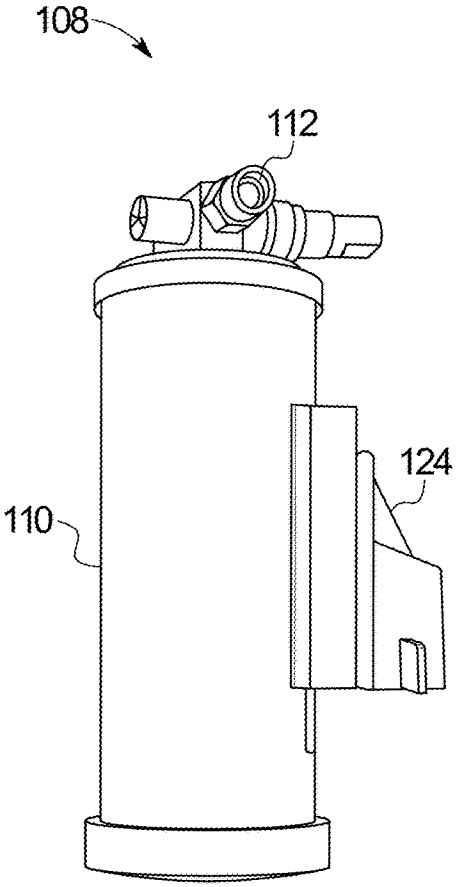

FIGS. 2A-2F depict exemplary receiver drier units of the refrigeration system in accordance with some embodiments of the present invention. FIG. 2A shows a receiver drier unit (108) including a receiver drier (110) and a first sensor (112) and a controller (124) installed at the receiver drier (110). FIG. 2B shows a receiver drier unit (108) including a receiver drier (110) and a controller (124) to be installed at the receiver drier (110). FIG. 2C shows a receiver drier unit (108) including a receiver drier (110), and a first sensor (112), a controller (124) and a refrigerant reservoir (128) that are installed at or mounted on the receiver drier (110). An electronic valve (126) is installed inside for injecting the refrigerant from the refrigerant reservoir (128) to the receiver drier (110) when the refrigerant level in the system is low.

Figure 2D:
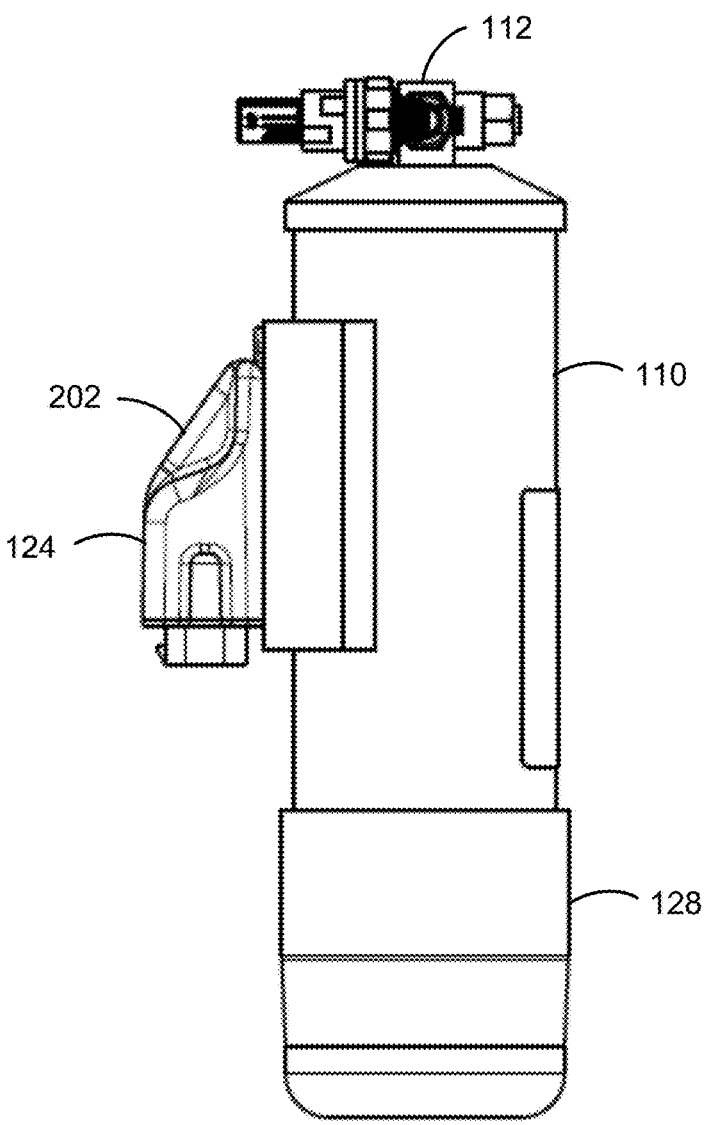
FIGS. 2D, 2E and 2F are side, back and top views illustrating a receiver drier unit of a refrigeration system in accordance with some embodiments of the present invention.
Figure 2E:
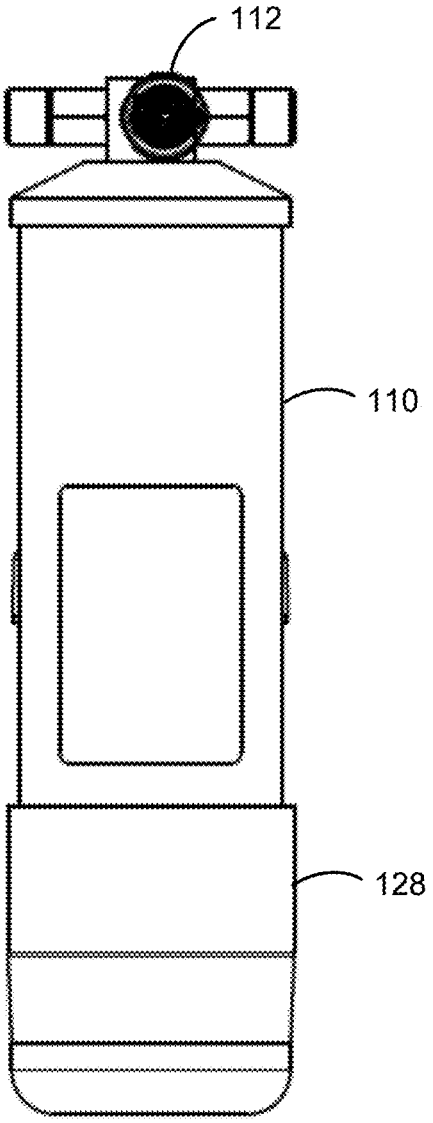
Figure 2F:
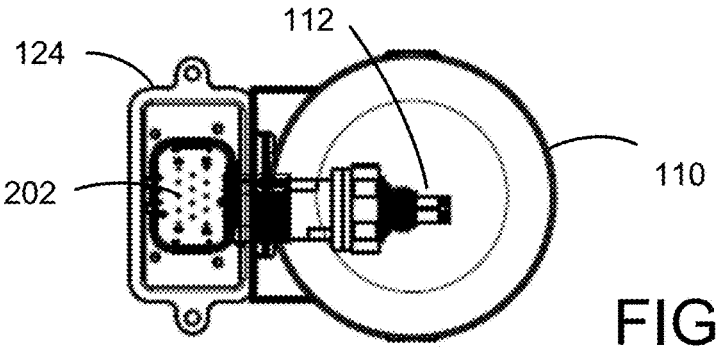

FIGS. 2D, 2E and 2F are side, back and top views illustrating a receiver drier unit of a refrigeration system in accordance with some embodiments of the present invention. By way of illustration, FIGS. 2D, 2E and 2F show a receiver drier unit (108) having a receiver drier (110), a first sensor (112) installed on the top of the receiver drier, a controller (124) mounted on a side wall of the receiver drier and a refrigerant reservoir (128) installed at the bottom or the bottom portion of the receiver drier. In the illustrated embodiment, the cross-section of the refrigerant reservoir (128) is similar to that of the receiver drier (e.g., circular), such that the bottom or the bottom portion of the receiver drier can be placed on or received by the refrigerant reservoir, making the integration of the receiver drier with the refrigerant reservoir easier and robust.

In some embodiments, the control (124) includes a control board (202), such as a screen, a key board or a user interface. The control board can be used for displaying data (e.g., the cooling level, the super-heating level and the refrigerant charge level), for communication (e.g., sending warning signals, maintenance request), for setting operation criteria (e.g., predetermined refrigerant charge level) or the like.

Similarly, an accumulator unit (114) can be configured to include an accumulator (116) and one or more of the following: a second sensor (118), a controller (124), an electronic valve (126), and a refrigerant reservoir (128). It should be noted that in an embodiment with both a receiver drier unit (108) and an accumulator unit (114), it is unnecessary to install a controller (124) at each of the receiver drier (110) and the accumulator (116). Likewise, it is unnecessary to install an electronic valve (126) or a refrigerant reservoir (128) at each of the receiver drier (110) and the accumulator (116).

Figure 3A:
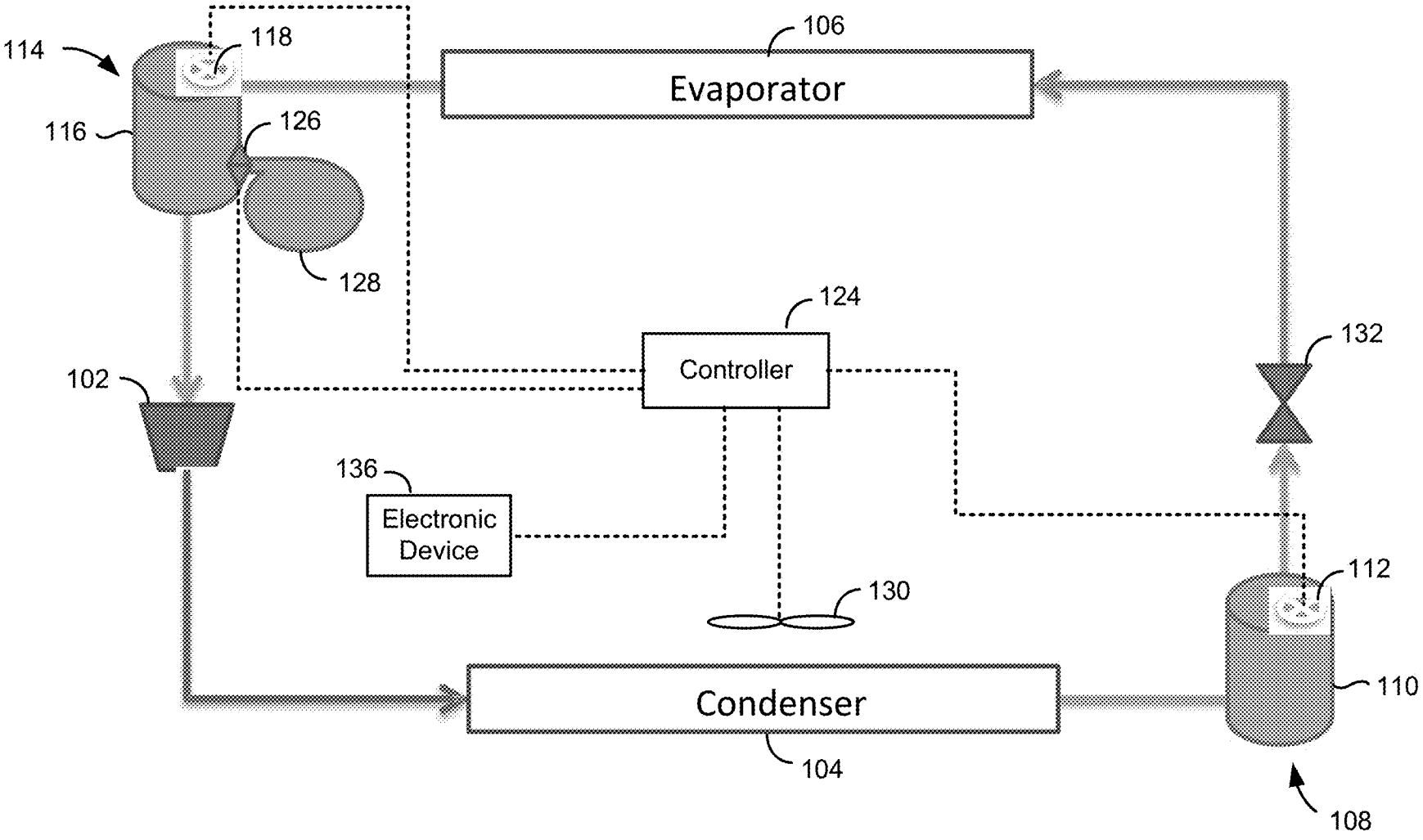
FIGS. 3A-3C, are block diagrams illustrating alternative configurations of the refrigeration system in accordance with some embodiments of the present invention.
Figure 3B:
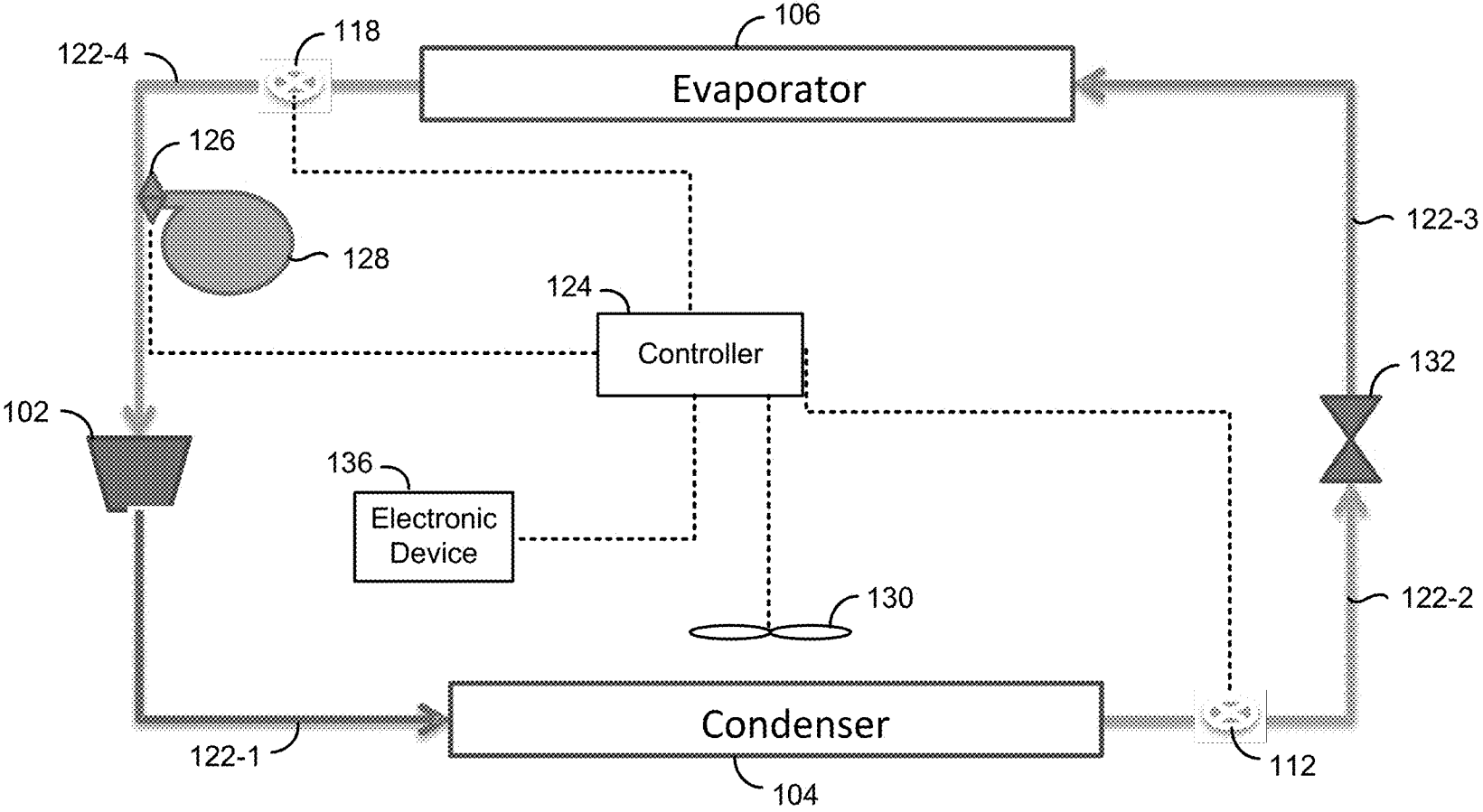
Figure 3C:
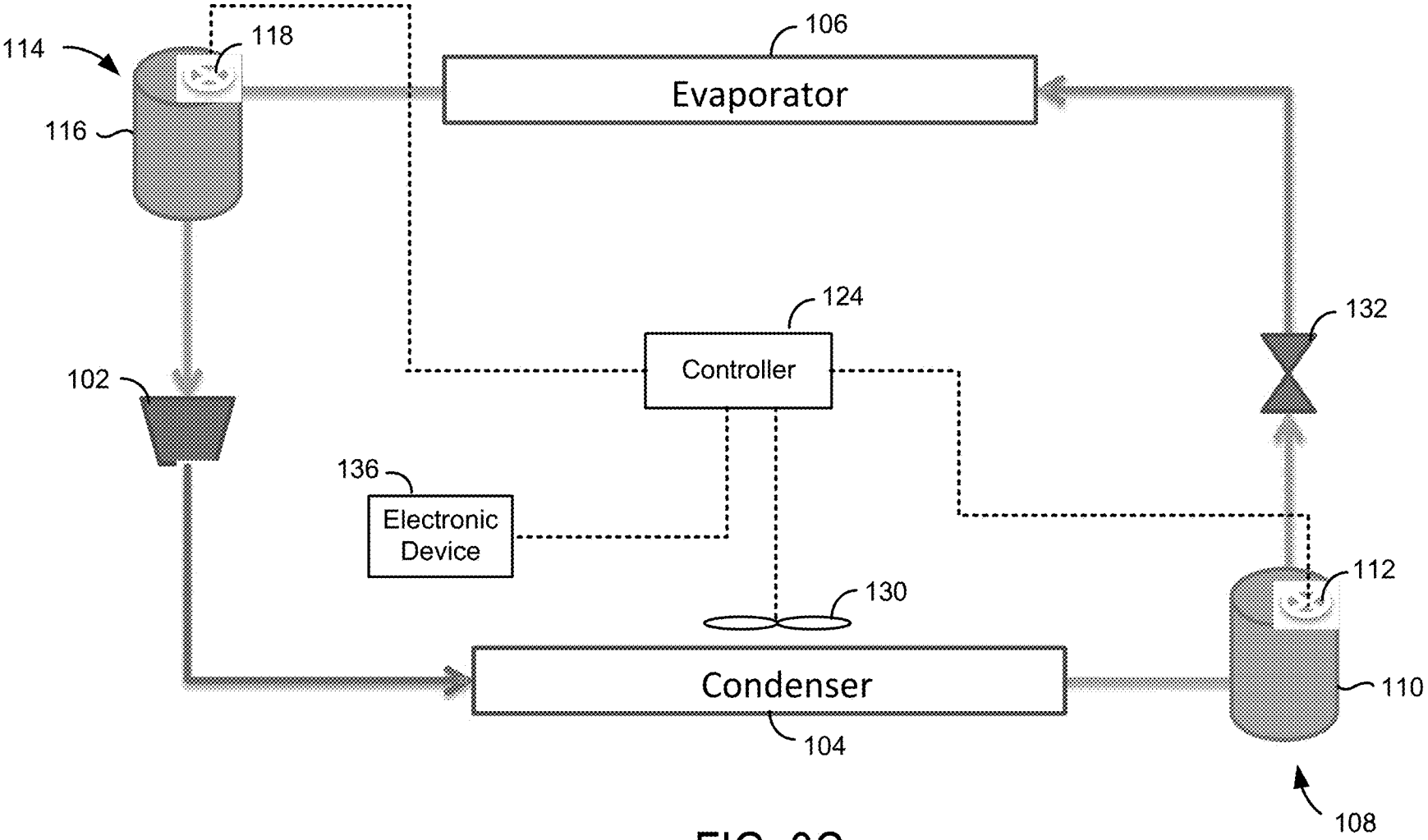

The refrigeration system of the present invention illustrated in FIG. 1 is exemplary and non-exclusive, and can be altered or modified. For instance, FIG. 3A illustrates an alternative configuration of the refrigeration system in which the electronic valve (126) is installed at the accumulator (116) instead of at the receiver drier (110) as illustrated in FIG. 1. In such embodiments, the refrigerant flows from the refrigerant reservoir (128) through the electronic valve (126) to the accumulator (116) when the refrigerant charge level in the refrigeration system is low. FIG. 3B illustrates another alternative configuration of the refrigeration system in which the electronic valve (126) is fluidly connected to the refrigerant circuit between the evaporator (106) and the compressor (102). In such embodiments, the refrigerant flows from the refrigerant reservoir (128) through the electronic valve (126) to the refrigerant circuit at the refrigerant line (122-4) when the refrigerant charge level in the refrigeration system is low. FIG. 3C illustrates yet another alternative configuration of the refrigeration system which does not include an electronic valve (126) for injecting refrigerant into the refrigeration system. In such embodiments, the refrigeration system outputs a signal to inform an operator or others when the refrigerant charge level in the refrigeration system is low. The operator or others can then manually replenish the refrigerant, schedule a maintenance appointment or take other proper actions.

Figure 4A:
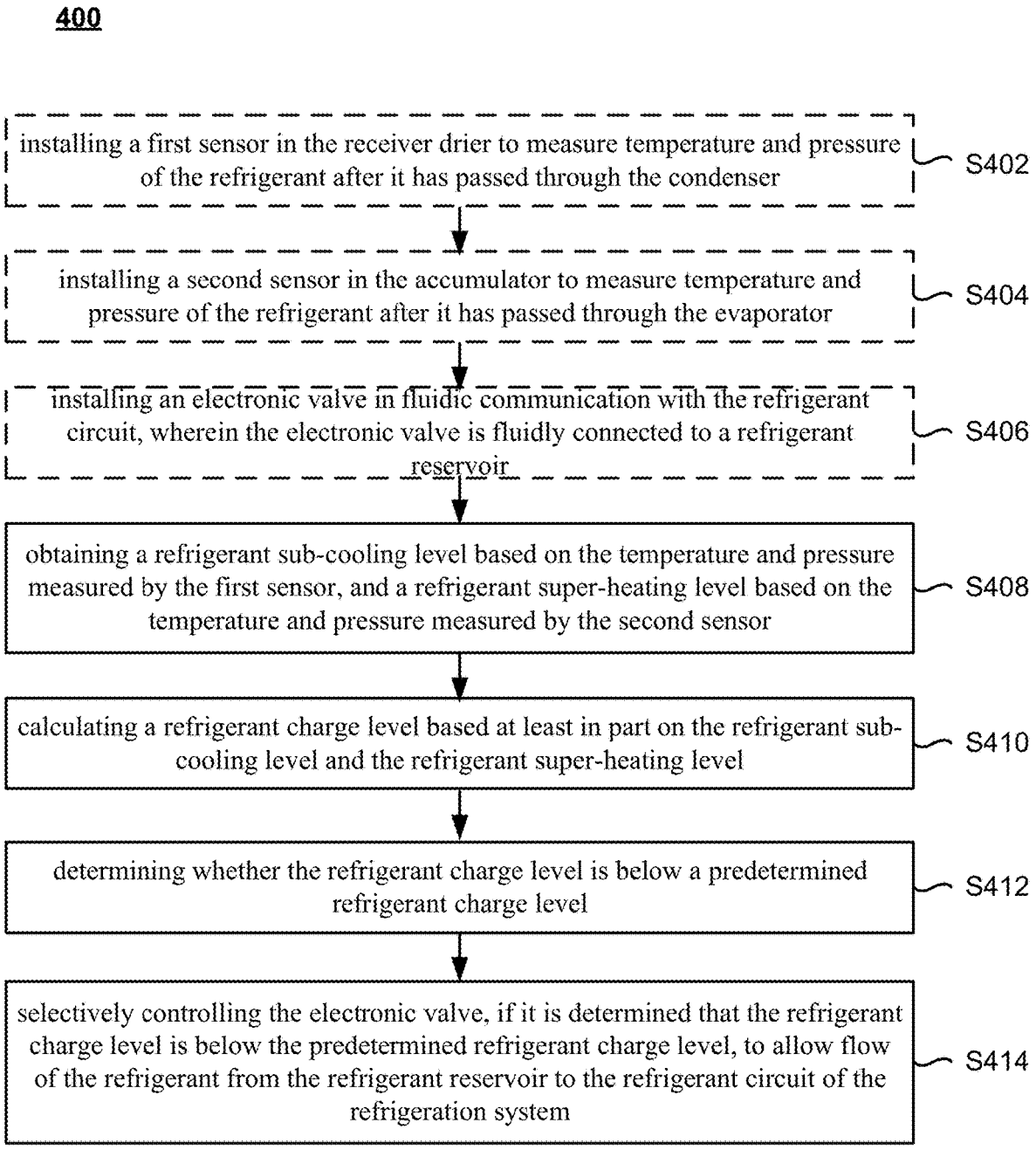
FIG. 4A is a flowchart illustrating a first exemplary method for controlling a refrigeration system in accordance with some embodiments of the present invention.

Turning now to FIG. 4A, there depicts a first method for controlling refrigeration systems in accordance with some embodiments of the present invention. For illustration purpose, the first method is described in the context of a refrigeration system that includes a first sensor (112) for measuring temperature and pressure of a refrigerant after it has passed through a condenser (104), a second sensor (118) for measuring temperature and pressure of the refrigerant after it has passed through an evaporator (106), and an electronic valve (126) fluidly connected to a refrigerant circuit of the refrigeration system and a refrigerant reservoir (128). In some embodiments, the refrigeration system includes a condenser (104) disposed downstream of the compressor (102), a receiver drier (110) disposed downstream of the condenser (104), an evaporator (106) disposed downstream of the receiver drier (110), an accumulator (116) disposed downstream of the evaporator (106), and refrigerant lines fluidly connecting the compressor (102), the condenser (104), the receiver drier (110), the evaporator (106) and the accumulator (116) in series to form a refrigerant circuit to circulate the refrigerant.

In some embodiments, the first method is governed by instructions that are stored in and executed by a controller such as the controller illustrated in FIGS. 1-3C. In some embodiments, the first method is governed by instructions that are stored in and executed by an electronic device other than the controller illustrated in FIGS. 1-3C.

In some embodiments, the first method includes: obtaining a refrigerant sub-cooling level based on the temperature and pressure of the refrigerant measured by the first sensor (112), and a refrigerant super-heating level based on the temperature and pressure of the refrigerant measured by the second sensor (S408); calculating a refrigerant charge level based at least in part on the refrigerant sub-cooling level and the refrigerant super-heating level (S410); determining whether the refrigerant charge level is below a predetermined refrigerant charge level (S412); and selectively controlling the electronic valve, if it is determined that the refrigerant charge level is below the predetermined refrigerant charge level, to allow flow of the refrigerant from the refrigerant reservoir to the refrigerant circuit of the refrigeration system, thereby raising the refrigerant charge level to above the predetermined refrigerant charge level (S414).

In some embodiments, the sub-cooling level is determined using a look-up table in accordance with the temperature and pressure measured by the first sensor. The super-heating level is determined using a look-up table in accordance with the temperature and pressure measured by the second sensor. The look-up tables for determining the sub-cooling level and the super-heating level can be separate tables or combined into one table. In some cases, the look-up table(s) is stored in a memory associated with the controller.

In some embodiments, prior to obtaining the refrigerant sub-cooling and/or super-heating levels (S408), the first method further includes one or more of the following: installing a first sensor at the receiver drier to measure temperature and pressure of the refrigerant after it has passed through the condenser (S402); installing a second sensor at the accumulator to measure temperature and pressure of the refrigerant after it has passed through the evaporator (S404); and installing an electronic valve in the refrigerant circuit, wherein the electronic valve is fluidly connected to a refrigerant reservoir (S406).

It should be noted that the processes illustrated in FIG. 4A are not necessarily fixed in a particular order. For instance, installing a first sensor at the receiver drier (S402) can be performed after a second sensor is installed at the accumulator (S404) and before an electronic valve is installed in the refrigerant circuit (S406), or after both the second sensor and the electronic valve are installed.

Also, it should be noted that some processes illustrated in FIG. 4A are additional or optional processes. For instance, in some cases where the refrigeration system is integrated with an existing A/C system or modified from the existing system with temperature sensors already installed in the low and/or high pressure sides of the refrigerant circuit, installing a first sensor at the receiver drier (S402) or installing a second sensor at the accumulator (S404) or both are unnecessary.

Figure 4B:
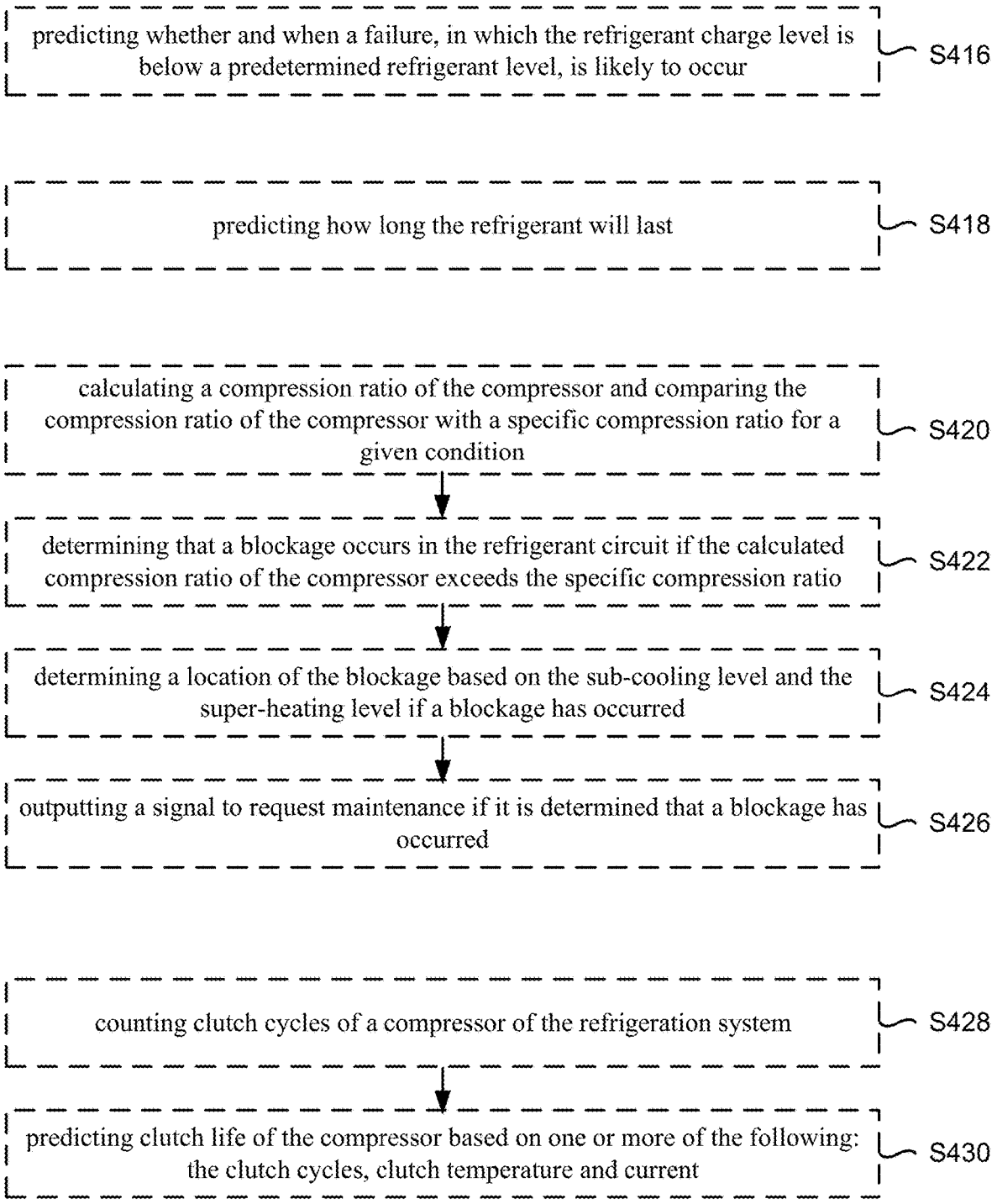
FIGS. 4B and 4C are flowcharts illustrating additional, optional or alternative processes of a method for controlling a refrigeration system in accordance with some embodiments of the present invention.
Figure 4C:
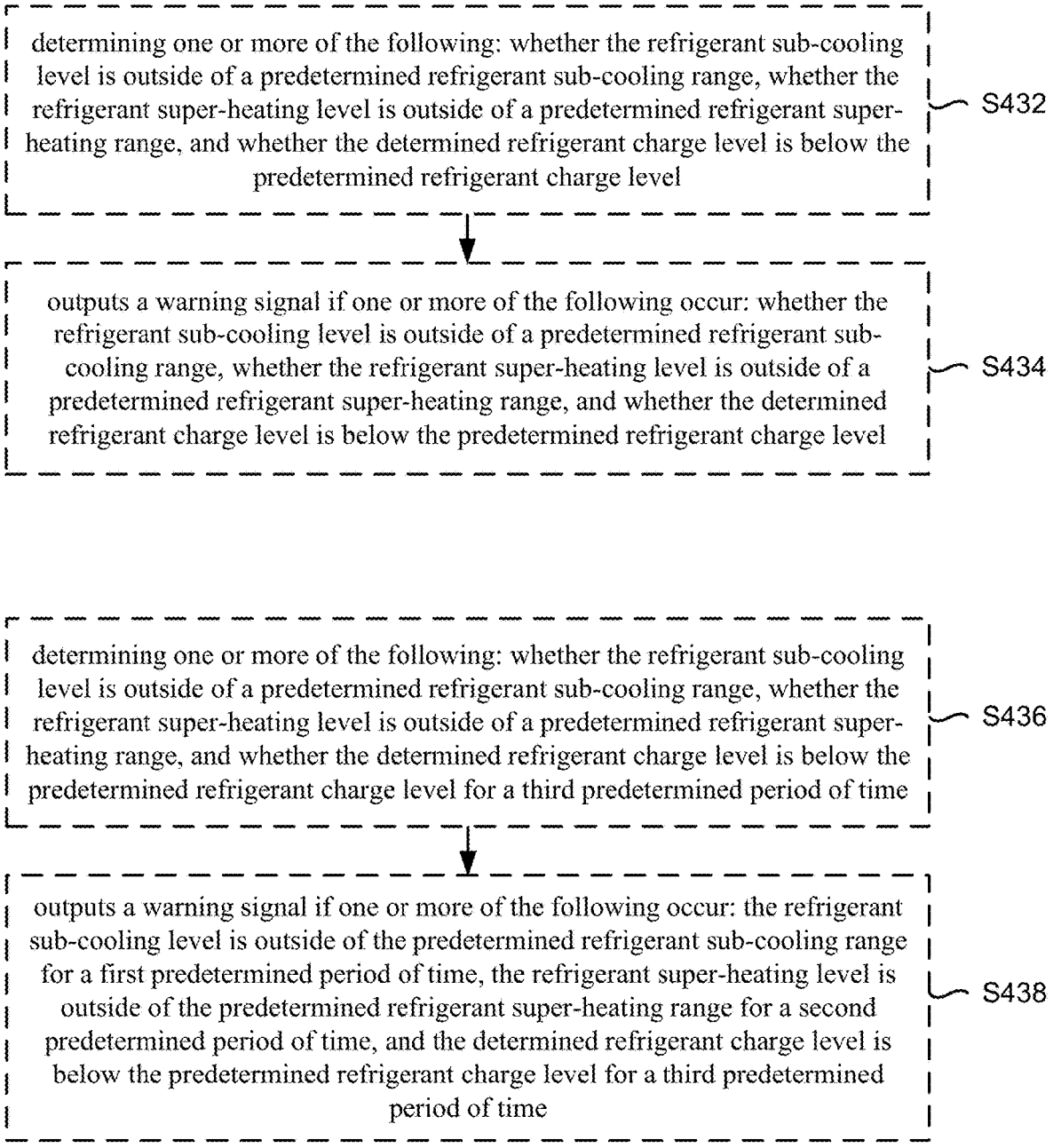

Further, the first method illustrated in FIG. 4A can include other alternative, additional or optional processes. As an example, FIGS. 4B and 4C illustrate some exemplary alternative, additional or optional processes. For instance, in some embodiments, subsequent to calculating the refrigerant charge level (S410), the first method includes one or more of the following processes: predicting whether and when a failure, in which the refrigerant charge level is below a predetermined refrigerant level, is likely to occur based on one or more of the following: a trend of the determined refrigerant charge levels over time, exterior temperature, interior temperature and humidity (S416); and predicting how long the refrigerant will last based on the sub-cooling level over time, the super-heating level over time, the refrigerant charge level, and/or other factors such as temperature and humidity inside and outside of the place where the refrigeration system is used (e.g., a vehicle) (S418).

Generally, a refrigeration system has an initial charge level. The controller learns how the refrigeration system operates and determines whether a charge level is low over time. In some cases, the controller uses the obtained super-heating level and sub-cooling in conjunction with power and ambient conditions to determine whether the refrigeration system is performing correctly. Then based on the normal operation "learned" over time, the controller determines whether the refrigerant charge level is low, e.g., below a predetermined refrigerant charge level. In some cases, the controller examines the trend of the refrigerant charge level over time and extrapolates the refrigerant charge level to predict how long the refrigerant will last and/or when the refrigerant charge level is likely to be below the predetermined refrigerant level.

In some embodiments, the first method includes one of more of the following additional processes: calculating a compression ratio of the compressor (102) and comparing the compression ratio of the compressor (102) with a specific compression ratio for a given condition (S420); determining that a blockage occurs in the refrigerant circuit if the calculated compression ratio of the compressor (102) exceeds the specific compression ratio (S422); determining a location of the blockage based on the sub-cooling level and the super-heating level if a blockage has occurred (S424); and outputting a signal to request maintenance if it is determined that a blockage has occurred (S426).

In some embodiments, the compression ratio is the ratio of the absolute discharge pressure of the compressor to the absolute suction pressure of the compressor, i.e., a value of the absolute discharge pressure of the compressor divided by the absolute suction pressure of the compressor. If it is determined that a blockage occurs in the refrigerant circuit, abnormal sub-cooling level indicates a blockage in the condenser and abnormal super-cooling indicates a blockage in the evaporator.

In some embodiments, the first method includes one of more of the following additional processes: counting clutch cycles of a compressor of the refrigeration system (S428); and predicting clutch life of the compressor based on one or more of the following: the clutch cycles, clutch temperature and current (S430).

In some embodiments, the first method includes one of more of the following additional processes: determining one or more of the following: whether the refrigerant sub-cooling level is outside of a predetermined refrigerant sub-cooling range, and whether the refrigerant super-heating level is outside of a predetermined refrigerant super-heating range (S432); and outputs a warning signal if one or more of the following occur: the determined sub-cooling level is outside of the predetermined sub-cooling range, the determined super-heating level is outside of the predetermined super-heating range, the determined refrigerant charge level is below the predetermined refrigerant charge level (S434). Alternatively, in some embodiments, the first method includes one of more of the following additional processes: determining one or more of the following: whether the refrigerant sub-cooling level is outside of a predetermined refrigerant sub-cooling range, whether the refrigerant super-heating level is outside of a predetermined refrigerant super-heating range, and whether the determined refrigerant charge level is below the predetermined refrigerant charge level for a third predetermined period of time (S436); and outputs a warning signal if one or more of the following occur: the refrigerant sub-cooling level is outside of the predetermined refrigerant sub-cooling range for a first predetermined period of time, the refrigerant super-heating level is outside of the predetermined refrigerant super-heating range for a second predetermined period of time, and the determined refrigerant charge level is below the predetermined refrigerant charge level for a third predetermined period of time (S438).

It should be noted that the first method can include any number of the alternative, additional or optional processes such as those illustrated in FIGS. 4B and 4C, in any combination and in any appropriate orders.

Figure 5:
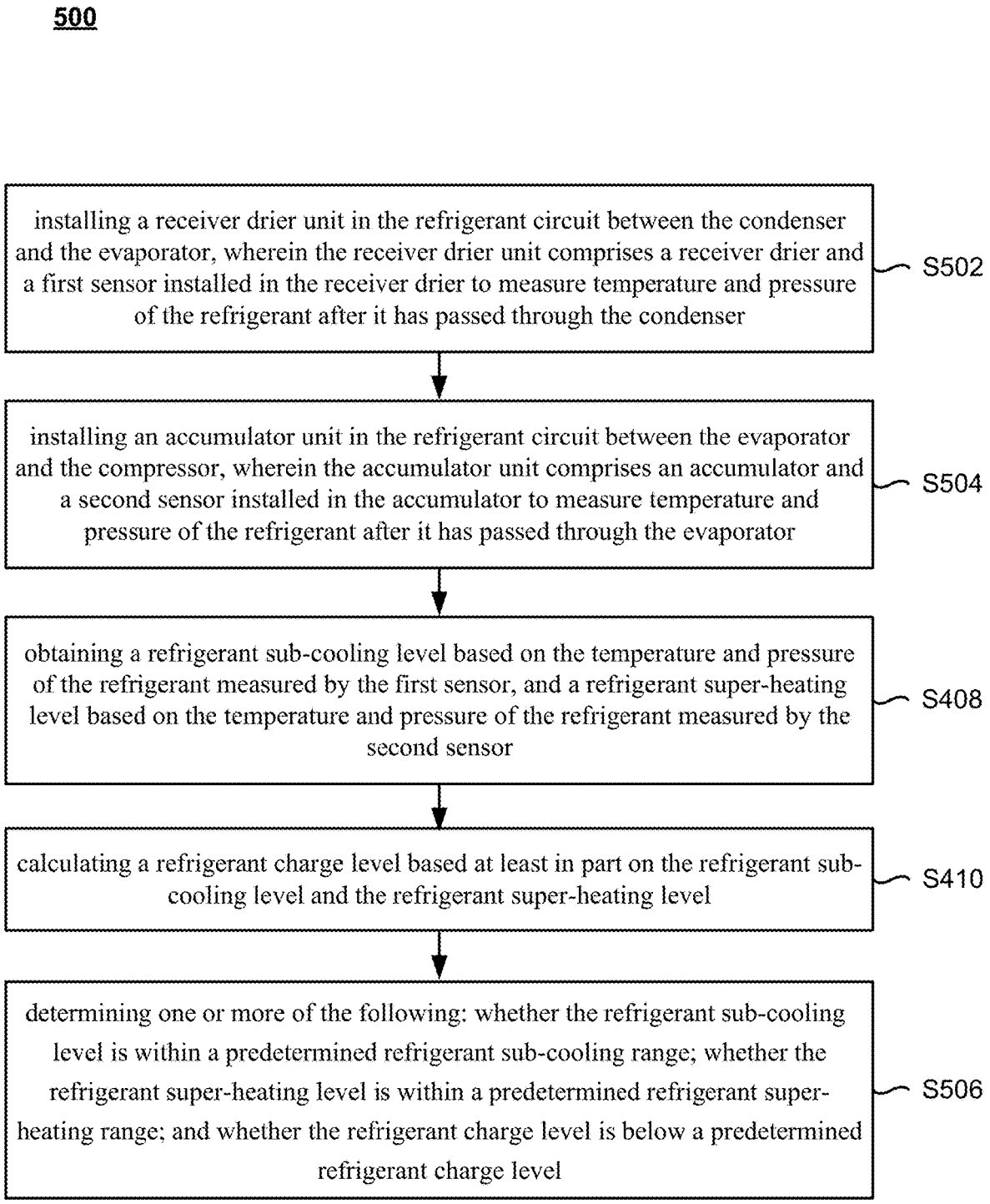
FIG. 5 is a flowchart illustrating a second exemplary method for controlling a refrigeration system in accordance with some embodiments of the present invention.

Referring now to FIG. 5, there depicts a second method for controlling refrigeration systems in accordance with some embodiments of the present invention. For illustration purpose, the second method are described in the context of a refrigeration system that includes a condenser disposed downstream of the compressor, an evaporator disposed downstream of the condenser, and refrigerant lines fluidly connecting the compressor, the condenser and the evaporator in series to form a refrigerant circuit to circulate the refrigerant.

Like the first method, in some embodiments, the second method is governed by instructions that are stored in and executed by a controller such as the controller illustrated in FIGS. 1-3C. In some embodiments, the second method is governed by instructions that are stored in and executed by an electronic device other than the controller illustrated in FIGS. 1-3C.

In some embodiments, the second method includes: installing a receiver drier unit in the refrigerant circuit between the condenser and the evaporator, wherein the receiver drier unit comprises a receiver drier and a first sensor installed at the receiver drier to measure temperature and pressure of the refrigerant after it has passed through the condenser (S502); installing an accumulator unit in the refrigerant circuit between the evaporator and the compressor, wherein the accumulator unit comprises an accumulator and a second sensor installed at the accumulator to measure temperature and pressure of the refrigerant after it has passed through the evaporator (S504); obtaining a refrigerant sub-cooling level based on the temperature and pressure of the refrigerant measured by the first sensor, and a refrigerant super-heating level based on the temperature and pressure of the refrigerant measured by the second sensor (S408); calculating a refrigerant charge level based at least in part on the refrigerant sub-cooling level and the refrigerant super-heating level (S410); and determining one or more of the following: whether the refrigerant sub-cooling level is within a predetermined refrigerant sub-cooling range; whether the refrigerant super-heating level is within a predetermined refrigerant super-heating range; and whether the refrigerant charge level is below a predetermined refrigerant charge level (S506).

Like the first method, the processes illustrated in FIG. 5 are not necessarily fixed in a particular order. For instance, installing a receiver drier unit (S502) can be conducted after installing an accumulator unit (S504).

Also, like the first method, some processes illustrated in FIG. 5 are additional or optional processes. For instance, in some cases where the refrigerant system uses an electrical compressor with an accumulator built into the suction line, installing an accumulator unit (S504) is unnecessary. In such cases, a sensor, if needed, may be installed at the low pressure side of the refrigerant circuit.

Further, like the first method, the second method can have alternative, additional or optional processes, including those illustrated in FIGS. 4B and 4C and discussed with respect to the first method. For instance, in some embodiments, the second method further includes one or more of the following: predicting whether and when a failure, in which the refrigerant charge level is below a predetermined refrigerant level, is likely to occur based on one or more of the following: a trend of the determined refrigerant charge levels over time, exterior temperature, interior temperature and humidity (S416); predicting how long the refrigerant will last based on the sub-cooling level over time, the super-heating level over time, the refrigerant charge level, and/or other factors such as temperature and humidity inside and outside of the place where the refrigeration system is used (e.g., a vehicle) (S418). In some embodiments, the second method further includes one or more of the following: calculating a compression ratio of the compressor and comparing the compression ratio of the compressor with a specific compression ratio for a given condition (S420); determining that a blockage occurs in the refrigerant circuit if the calculated compression ratio of the compressor exceeds the specific compression ratio (S422); determining a location of the blockage based on the sub-cooling level and the super-heating level if a blockage has occurred (S424); and outputting a signal to request maintenance if it is determined that a blockage has occurred (S426).

The refrigeration systems and control methods of the present invention are advantageous in many ways. For instance, with the sensor(s) installed at the receiver drier and/or the accumulator, the present invention provides a smaller and more space efficient system, which requires less maintenance, and makes leak testing easier. Moreover, with an electronic valve connected to a refrigerant reservoir and integrated to the receiver drier, the accumulator or the refrigerant circuit, the refrigeration system of the present invention can continue functioning properly for some additional period of time, allowing an operator to schedule a maintenance appointment to avoid costly unscheduled maintenance or take other appropriate actions. Further, the controller helps predict whether a failure is likely to occur and can notify an operator, dealer or others if a failure occurs or is likely to occur.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that, although the terms "first," "second," etc. may be used herein to describe various elements, these elements should not be limited by these terms. These terms are only used to distinguish one element from another. For example, a first sensor could be termed a second sensor, and, similarly, a second sensor could be termed a first sensor, without changing the meaning of the description, so long as all occurrences of the "first sensor" are renamed consistently and all occurrences of the "second sensor" are renamed consistently.

What is claimed is:

1. A refrigeration system, comprising:

a refrigerant reservoir;

a compressor to compress a refrigerant;

a condenser disposed downstream of the compressor to condense the refrigerant;

an evaporator disposed downstream of the condenser to vaporize the refrigerant;

refrigerant lines fluidly connecting the compressor, the condenser and the evaporator in series to form a refrigerant circuit for circulating the refrigerant;

at least one sensor configured to measure a temperature of the refrigerant and a pressure of the refrigerant in the refrigerant circuit; and a controller communicatively coupled to the at least one sensor and configured to:

determine a sub-cooling level or super-heating level based on the temperature or the pressure measured by the at least one sensor;

determine a refrigerant charge level based at least in part on the sub-cooling level or the super-heating level;

determine whether the refrigerant charge level is below a predetermined refrigerant charge level; and in accordance with a determination that the refrigerant charge level is below the predetermined refrigerant charge level, selectively inject additional refrigerant from the refrigerant reservoir to the refrigerant circuit, thereby raising the refrigerant charge level to at least the predetermined refrigerant charge level.

2. The system of claim 1, further comprising a receiver drier disposed between the condenser and the evaporator, the receiver drier configured to perform one or more of the following:

temporarily store the refrigerant; and absorb moisture from the refrigerant; and wherein the at least one sensor includes a first sensor installed at the receiver drier to measure temperature and pressure of the refrigerant after it has passed through the condenser.

3. The system of claim 2, wherein the controller is further configured to determine the sub-cooling level based on the temperature and pressure measured by the first sensor.

4. The system of claim 1, further comprising an accumulator disposed between the evaporator and the compressor, the accumulator configured to restrict liquid refrigerant from entering the compressor; and wherein the at least one sensor includes a first sensor installed at the accumulator to measure temperature and pressure of the refrigerant after it has passed through the evaporator.

5. The system of claim 4, wherein the controller is further configured to determine a super-heating level based on the temperature and pressure measured by the first sensor.

6. The system of claim 1, further comprising an electronic valve fluidly connected to the refrigerant reservoir; and wherein the electronic valve is configured to enable flow of the additional refrigerant from the refrigerant reservoir to the refrigerant circuit, wherein the flow is driven in-part by a pressure difference between the refrigerant reservoir and the refrigerant circuit, thereby maintaining the refrigerant charge level at least at the predetermined refrigerant charge level.

7. The system of claim 1, further comprising:

an electronic valve fluidly connected to the refrigerant circuit and the refrigerant reservoir; and wherein the controller operates the electronic valve to be selectively opened or closed in accordance with the determined sub-cooling level or super-heating level, thereby enabling flow of the refrigerant from the refrigerant reservoir to the refrigerant circuit.

8. The system of claim 1, wherein the at least one sensor includes a first temperature sensor and a first pressure sensor.

9. The system of claim 1, wherein controller is further configured to determine at least one of the sub-cooling level or the super-heating level using a look-up table in accordance with the temperature and pressure measured by the at least one sensor.

10. The system of claim 1, wherein the controller is further configured to:

determine a plurality of refrigerant charge levels by determining, at each of a plurality of distinct times, a respective refrigerant charge level based at least in part on a respective sub-cooling or super-heating level; and predict whether the refrigerant charge level will be below a predetermined refrigerant level during a subsequent time period based on the determined plurality of refrigerant charge levels.

11. The system of claim 10, wherein predicting whether the refrigerant charge level will be below the predetermined refrigerant level is based on one or more of the following: a trend of the determined plurality of refrigerant charge levels over time, exterior temperature, interior temperature, and humidity.

12. The system of claim 10, wherein the controller is further configured to predict how long the refrigerant will last based on the determined plurality of refrigerant charge levels.

13. The system of claim 1, wherein the controller is further configured to perform one or more of the following:

calculate a compression ratio of the compressor;

determine whether a blockage has occurred in the refrigerant circuit based on the calculated compression ratio; and determine a location of the blockage based on at least one of the determined sub-cooling level or the determined super-heating level.

14. The system of claim 13, wherein the controller is further configured to output a signal to request maintenance if it is determined that a blockage has occurred.

15. The system of claim 1, wherein the controller is electrically coupled to the compressor and further configured to:

count clutch cycles of the compressor; and predict clutch life of the compressor based on at least one of the clutch cycles, a clutch temperature, or a current through the compressor.

16. The system of claim 1, wherein the controller is communicatively coupled to an electronic device and further configured to output information regarding at least one of the sub-cooling level or the super-heating level to the electronic device.

17. The system of claim 1, wherein the controller is communicatively coupled to an electronic device and further configured to output a warning signal in accordance with a determination that at least one of:

the determined sub-cooling level is outside of a predetermined sub-cooling range; or the determined super-heating level is outside of a predetermined super-heating range.

18. The system of claim 1, wherein the controller is communicatively coupled to an electronic device and configured to output a warning signal in accordance with a determination that at least one of:

the determined sub-cooling level is outside of a predetermined sub-cooling range for a first predetermined period of time; or the determined super-heating level is outside of a predetermined super-heating range for a second predetermined period of time.

19. The system of claim 1, wherein the refrigeration system is installed in a vehicle; and wherein the compressor is configured to be driven by an internal combustion engine of the vehicle.

20. The system of claim 1, wherein the compressor is an electrically driven compressor.

21. A method for controlling a refrigeration system, comprising:

measuring, at one or more sensors, temperature and pressure of refrigerant within a refrigerant circuit of the refrigeration system;

determining a refrigerant sub-cooling level or a refrigerant super-heating level based on the temperature and pressure of the refrigerant;

determining a refrigerant charge level based at least in part on the refrigerant sub-cooling level or the refrigerant super-heating level;

determining whether the refrigerant charge level is below a predetermined refrigerant charge level; and in accordance with a determination that the refrigerant charge level is below the predetermined refrigerant charge level, selectively injecting additional refrigerant to the refrigerant circuit, thereby raising the refrigerant charge level to at least the predetermined refrigerant charge level.

22. The method of claim 21, wherein determining the refrigerant charge level includes calculating the refrigerant charge level based at least in part on the refrigerant sub-cooling level and the refrigerant super-heating level wherein selectively injecting the additional refrigerant to the refrigerant circuit includes selectively controlling a refrigerant valve to enable flow of the refrigerant from a refrigerant reservoir to the refrigerant circuit.

23. The method of claim 21, further comprising determining a plurality of refrigerant charge levels by determining, at each of a plurality of distinct times, a respective refrigerant charge level based at least in part on a respective sub-cooling or super-heating level; and predicting whether the refrigerant charge level will be below the predetermined refrigerant level during a subsequent time period based on the determined plurality of refrigerant charge levels.

24. The method of claim 23, further comprising determining how long the refrigerant will last based on the determined plurality of refrigerant charge levels.

25. The method of claim 21, further comprising calculating a compression ratio of a compressor of the refrigeration system; and determining whether a blockage has occurred in the refrigerant circuit based on the calculated compression ratio; and determining a location of the blockage based on at least one of the sub-cooling level or the super-heating level.

26. The method of claim 21, further comprising sending information regarding at least one of the sub-cooling level or the super-heating level to an electronic device.

27. The method of claim 21, further comprising sending an alert to an electronic device in accordance with a determination that at least one of:

the determined sub-cooling level is outside of a predetermined sub-cooling range for a first predetermined period of time; or the determined super-heating level is outside of a predetermined super-heating range for a second predetermined period of time.

* * * * *